US012729864B2

(12) United States Patent
Kim et al.

(10) Patent No.: US 12,729,864 B2
(45) Date of Patent: Sep. 8, 2026

(54) WINDOW-TYPE AIR-CONDITIONER

(71) Applicant: Samsung Electronics Co., Ltd., Suwon-si (KR)

(72) Inventors: Munsub Kim, Suwon-si (KR); Duhan Jung, Suwon-si (KR); Sungtae Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 169 days.

(21) Appl. No.: 18/431,572

(22) Filed: Feb. 2, 2024

(65) Prior Publication Data

US 2024/0263808 A1 Aug. 8, 2024

Related U.S. Application Data

(63) Continuation of application No. PCT/KR2024/001361, filed on Jan. 29, 2024.

(30) Foreign Application Priority Data

Feb. 2, 2023 (KR) ..... 10-2023-0014455

(51) Int. Cl.
*F24F 1/027* (2019.01)
*F24F 1/031* (2019.01)
(Continued)

(52) U.S. Cl.
CPC ..... *F24F 1/027* (2013.01); *F24F 1/031* (2019.02); *F24F 1/0326* (2019.02); *F24F 1/26* (2013.01);
(Continued)

(58) Field of Classification Search
CPC ..... F24F 1/027; F24F 1/031; F24F 1/26
See application file for complete search history.

(56) References Cited

U.S. PATENT DOCUMENTS 2,756,569 A 7/1956 Kritzer
3,309,889 A * 3/1967 Copp, Jr. ..... F24F 1/031 62/262
(Continued)

FOREIGN PATENT DOCUMENTS

CN 2220604 Y 2/1996
CN 201322387 Y 10/2009
(Continued)

OTHER PUBLICATIONS

Machine translation of KR20170090926A (Year: 2017).*
(Continued)

*Primary Examiner* — Christopher R Zerphey
(74) *Attorney, Agent, or Firm* — STAAS & HALSEY LLP

(57) ABSTRACT

A window-type air-conditioner installable on a window frame, and including an outdoor module including a compressor to compress a coolant, an outdoor heat exchanger to generate heat exchange between outdoor air and the coolant, and an outdoor housing accommodating the compressor and the outdoor heat exchanger; an indoor module including an indoor heat exchanger to generate heat exchange between indoor air and the coolant, and an indoor housing spaced apart from the outdoor housing, and accommodating the indoor heat exchanger; a coolant pipe along which the coolant moves between the outdoor and indoor modules; and a pipe cover accommodating the coolant pipe, and connecting the indoor and outdoor modules. The coolant pipe has a spiral shape that is expandable and compressible, and the pipe cover structure is expandable and compressible, to adjust an interval between the outdoor and indoor modules to correspond to a thickness of the window frame.

10 Claims, 32 Drawing Sheets

(51) Int. Cl.

| | |
|---|---|
| ***F24F 1/0326*** | (2019.01) |
| ***F24F 1/26*** | (2011.01) |
| ***F24F 13/02*** | (2006.01) |
| ***F24F 13/24*** | (2006.01) |
| ***F24F 13/32*** | (2006.01) |

(52) U.S. Cl.
CPC ..... *F24F 13/02* (2013.01); *F24F 13/24* (2013.01); *F24F 13/32* (2013.01); *F24F 2221/20* (2013.01)

(56) References Cited

U.S. PATENT DOCUMENTS

| | | | | |
|---|---|---|---|---|
| 3,438,219 | A * | 4/1969 | Brugler | F24F 1/029 62/448 |
| 5,167,131 | A * | 12/1992 | Karkhanis | F24F 1/027 62/262 |
| 5,313,806 | A | 5/1994 | Feng | |
| 6,671,974 | B2 * | 1/2004 | Polk, Jr. | F24F 1/26 33/645 |
| 6,983,621 | B2 * | 1/2006 | Cur | F24F 1/027 62/262 |
| 7,992,404 | B2 * | 8/2011 | Su | F24F 1/027 62/262 |
| 8,850,832 | B2 * | 10/2014 | Lingrey | F24F 1/20 62/262 |
| 10,082,230 | B2 * | 9/2018 | Dieduksman | F16L 21/06 |
| 10,364,924 | B2 * | 7/2019 | Girola | F16L 25/0045 |
| 10,415,838 | B2 * | 9/2019 | Kim | F24F 1/027 |
| 10,429,094 | B2 | 10/2019 | Mavrommatis | |
| 10,739,018 | B2 * | 8/2020 | Baumann | F24F 13/32 |
| 11,384,945 | B2 * | 7/2022 | Aryeh | F24F 13/20 |
| 11,913,665 | B2 * | 2/2024 | Kim | F24F 13/06 |
| 12,203,665 | B2 * | 1/2025 | Leezer | F24F 13/32 |
| 2003/0097854 | A1 | 5/2003 | Cur et al. | |
| 2009/0107162 | A1 | 4/2009 | Su et al. | |
| 2021/0190330 | A1 | 6/2021 | Martinez Galvan | |
| 2022/0057109 | A1 | 2/2022 | Leezer et al. | |
| 2023/0013389 | A1 | 1/2023 | Bradford et al. | |
| 2025/0207788 | A1 * | 6/2025 | Kim | F24F 1/027 |
| 2025/0283613 | A1 * | 9/2025 | Kim | F24F 13/20 |

FOREIGN PATENT DOCUMENTS

| | | | |
|---|---|---|---|
| CN | 201439971 | U | 4/2010 |
| CN | 109724165 | A | 5/2019 |
| CN | 208998189 | U | 6/2019 |
| CN | 112268318 | A | 1/2021 |
| JP | 6-35829 | | 5/1994 |
| JP | 2005-24125 | | 1/2005 |
| KR | 10-1996-0038272 | | 11/1996 |
| KR | 2002-0097326 | A | 12/2002 |
| KR | 2003-0009795 | | 2/2003 |
| KR | 2003-0073194 | | 9/2003 |
| KR | 10-2005-0116217 | | 12/2005 |
| KR | 10-2017-0090926 | | 8/2017 |
| KR | 10-2018-0086747 | | 8/2018 |
| KR | 10-2088466 | B1 | 3/2020 |
| KR | 10-2020-0135085 | | 12/2020 |
| KR | 10-2021-0080821 | | 7/2021 |
| KR | 10-2311991 | B1 | 10/2021 |
| KR | 10-2458493 | | 10/2022 |
| KR | 10-2522051 | | 4/2023 |

OTHER PUBLICATIONS

Machine Translation of KR20210080821 (Year: 2021).*
International Search Report dated Apr. 30, 2024 for PCT Patent Application No. PCT/KR2024/001361.
Extended European Search Report dated Mar. 13, 2026 for EP Patent Application No. 24750521.7.

* cited by examiner

WINDOW-TYPE AIR-CONDITIONER

CROSS-REFERENCE TO RELATED APPLICATIONS

This application is a continuation application, under 35 U.S.C. § 111(a), of International Application No. PCT/KR2024/001361, filed on Jan. 29, 2024, which claims priority under 35 U.S.C. § 119 to Korean Patent Application 10-2023-0014455, filed on Feb. 2, 2023, in the Korean Intellectual Property Office, the disclosures of which are incorporated by reference herein in their entireties.

TECHNICAL FIELD

The disclosure relates to a window-type air-conditioner.

BACKGROUND ART

An air-conditioner may include an outdoor module including a compressor configured to compress a coolant, a heat exchanger (a condenser or an evaporator) for inducing heat exchange with the coolant, an expansion valve, and an air blower for facilitating the heat exchange with the coolant.

Air-conditioners may be classified into a separate-type air-conditioner in which an indoor unit and an outdoor unit are respectively installed indoors and outdoors, and a window-type air-conditioner in which the indoor unit and the outdoor unit are installed on a window frame.

As a window-type air-conditioner is installable on a window frame, installing the window-type air-conditioner is easy. However, due to the installation of a window-type air-conditioner, a gap may be formed between a window and a window frame, which may allow external noise, for example, noise of a compressor, to enter the room. Thus, the noise may cause discomfort for a user of the window-type air-conditioner.

DISCLOSURE

Technical Solution

According to an embodiment of the disclosure, a window-type air-conditioner is installable on a window frame, and includes an outdoor module including a compressor configured to compress a coolant, an outdoor heat exchanger configured to generate heat exchange between outdoor air and the coolant, and an outdoor housing accommodating the compressor and the outdoor heat exchanger; an indoor module including an indoor heat exchanger configured to generate heat exchange between indoor air and the coolant, and an indoor housing spaced apart from the outdoor housing, and accommodating the indoor heat exchanger; a coolant pipe providing a flow path along which the coolant moves between the outdoor module and the indoor module; and a pipe cover accommodating the coolant pipe, and connecting the indoor module and the outdoor module, wherein the coolant pipe has a spiral shape that is expandable and compressible, and the pipe cover has a structure that is expandable and compressible, to adjust an interval between the outdoor module and the indoor module so that the interval corresponds to a thickness of the window frame.

According to an embodiment of the disclosure, the coolant pipe may be wound multiple times in the spiral shape around a virtual center axis.

According to an embodiment of the disclosure, the virtual center axis of the coolant pipe may extend in a direction from the outdoor module toward the indoor module.

According to an embodiment of the disclosure, a virtual projection trajectory formed by an outer circumference of the spiral shape of the coolant pipe may include two line segments parallel to each other, a first curved line connecting a first pair of end portions of the two line segments to each other, and a second curved line connecting a second pair of end portions of the two line segments to each other.

According to an embodiment of the disclosure, a virtual projection trajectory formed by an outer circumference of the spiral shape of the coolant pipe may be oval.

According to an embodiment of the disclosure, the coolant pipe may include a first coolant pipe providing a first flow path along which the coolant moves from the outdoor module to the indoor module, and a second coolant pipe providing a second flow path along which the coolant moves from the indoor module to the outdoor module. A virtual projection trajectory formed by an outer circumference of the spiral shape of the first coolant pipe may be greater than a virtual projection trajectory formed by an outer circumference of the spiral shape of the second coolant pipe.

According to an embodiment of the disclosure, the virtual projection trajectory of the second coolant pipe may be formed inside the virtual projection trajectory of the first coolant pipe.

According to an embodiment of the disclosure, the coolant pipe may include a metal pipe.

According to an embodiment of the disclosure, the window-type air-conditioner may further include a coil spring surrounding the coolant pipe, and configured to reduce stress on the coolant pipe when the interval between the outdoor module and the indoor module is adjusted.

According to an embodiment of the disclosure, the window-type air-conditioner may further include a temporary support portion supporting the indoor module and the outdoor module at a fixed interval, and configured to be removed before the window-type air-conditioner is installed on the window frame.

According to an embodiment of the disclosure, the structure of the pipe cover may be a bellows structure including a plurality of corrugations.

According to an embodiment of the disclosure, the window-type air-conditioner may further include a sealing member coupled to the pipe cover, and configured to provide a seal between an outer circumferential surface of the pipe cover and the window frame on a plane perpendicular to a direction in which the pipe cover extends. The sealing member may include a coupling surface in contact with the outer circumferential surface of the pipe cover, the coupling surface including an uneven portion corresponding to the plurality of corrugations of the pipe cover.

According to an embodiment of the disclosure, a window-type air-conditioner is installable on a window frame, and includes an outdoor module including a compressor configured to compress a coolant, an outdoor heat exchanger configured to generate heat exchange between outdoor air and the coolant, and an outdoor housing accommodating the compressor and the outdoor heat exchanger; an indoor module including an indoor heat exchanger and configured to generate heat exchange between indoor air and the coolant, and an indoor housing spaced apart from the outdoor housing, and accommodating the indoor heat exchanger; and a flexible coolant pipe providing a flow path along which the coolant moves between the outdoor module and the indoor module; and a temporary support portion supporting the indoor module and the outdoor module, and configured to be removed before the window-type air-conditioner is installed on the window frame, wherein an interval between the outdoor module and the indoor module is adjustable to correspond to a thickness of the window frame, and the flexible coolant pipe has a shape that deforms as the interval between the outdoor module and the indoor module is adjusted.

According to an embodiment of the disclosure, the outdoor module and the indoor module may respectively include first coupling portions, the temporary support portion may include a plurality of second coupling portions, and the first coupling portions of the outdoor module and the indoor module may respectively correspond to second coupling portions of the plurality of second coupling portions of the temporary support portion so that the temporary support portion may be detachably couplable to the outdoor module and the indoor module.

According to an embodiment of the disclosure, the temporary support portion may fix the interval between the indoor module and the outdoor module while the first coupling portions and the plurality of second coupling portions are interlocked with each other.

Advantageous Effects

A window-type air-conditioner according to an embodiment of the disclosure may provide a comfortable indoor environment for a user by separating the indoor module and the outdoor module from each other so that noise occurred from the outdoor module is not transmitted to the room.

A window-type air-conditioner according to an embodiment of the disclosure may provide insulation between the indoor and the outdoor by providing a structure that may close the window as much as possible.

A window-type air-conditioner according to an embodiment of the disclosure may provide a coolant pipe through which the coolant may be transferred between the indoor module and the outdoor, even when the interval between the outdoor module and the indoor module is adjusted.

A window-type air-conditioner according to an embodiment of the disclosure may provide a coolant pipe for stably transferring the coolant while changing a shape between the outdoor module and the indoor module, even when the interval between the indoor module and the outdoor module is adjusted.

A window-type air-conditioner according to an embodiment of the disclosure may provide a coolant pipe having an adjustable length and preventing coolant leakage.

A window-type air-conditioner according to an embodiment of the disclosure may provide a coolant pipe having an adjustable length and including a metal material.

A window-type air-conditioner according to an embodiment of the disclosure may provide a flexible coolant pipe including a plurality of layers so as to have shape deformation and preventing coolant leakage.

A window-type air-conditioner according to an embodiment of the disclosure may provide a temporary support portion for firmly fixing the outdoor module and the indoor module before the window-type air-conditioner is installed on a window frame.

BEST MODE

Figure 1:
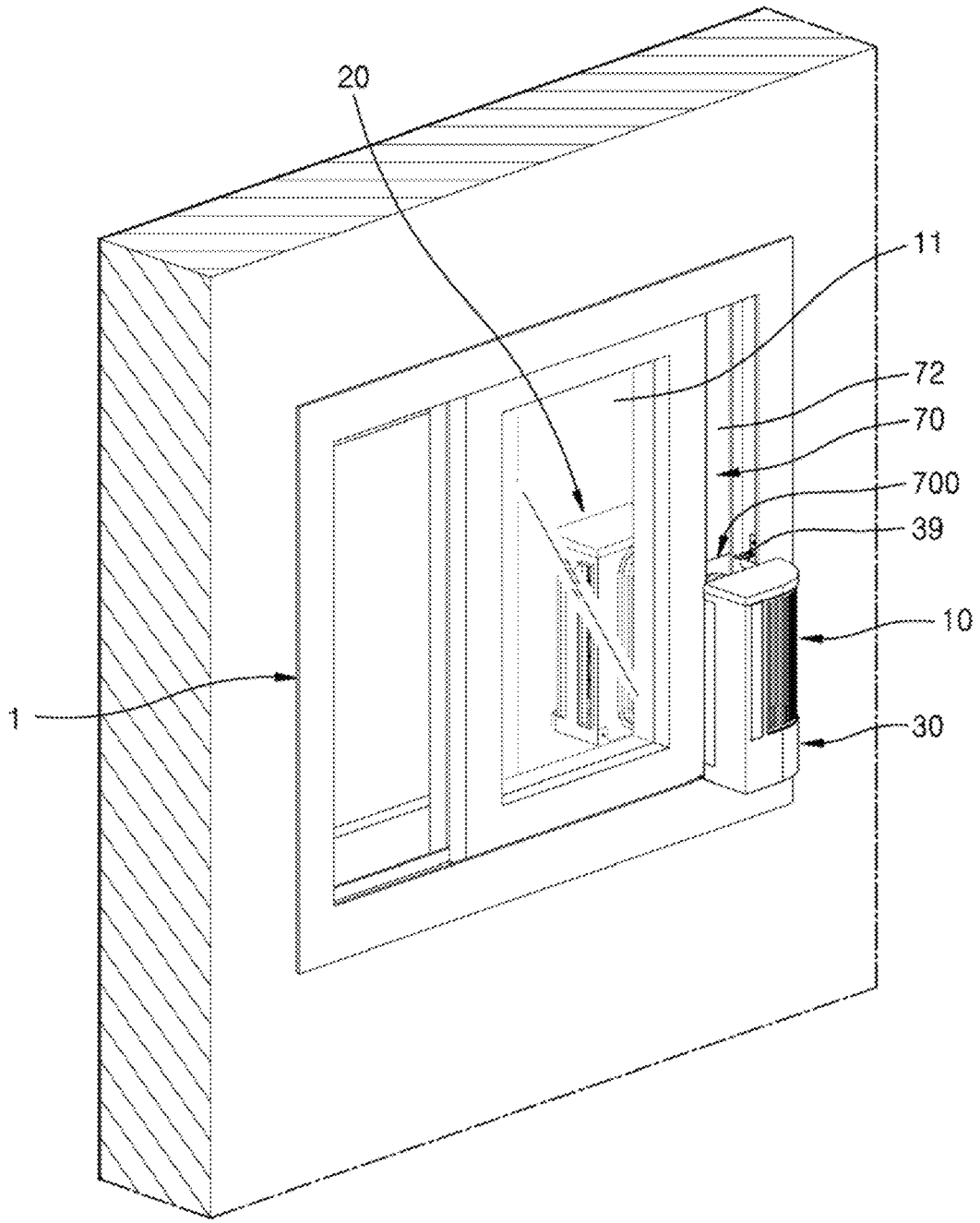
FIG. 1 is a view illustrating that a window-type air-conditioner according to an embodiment of the disclosure is installed on a window frame.

A window-type air-conditioner according to an embodiment of the disclosure, as a window-type air-conditioner that is installable on a window frame, includes an outdoor module including a compressor configured to compress a coolant, an outdoor heat exchanger configured to generate heat exchange between outdoor air and the coolant, and an outdoor housing accommodating the compressor and the outdoor heat exchanger, an indoor module including an indoor housing apart from the outdoor housing and an indoor heat exchanger arranged inside the indoor housing and configured to generate heat exchange between indoor air and the coolant, a coolant pipe configured to provide a flow path along which the coolant moves between the outdoor module and the indoor module, and a pipe cover accommodating the coolant pipe and connecting the indoor module and the outdoor module to each other to allow adjustment of an interval between the outdoor module and the indoor module, wherein the coolant pipe has a spiral shape enabling adjustment of the interval between the outdoor module and the indoor module.

The coolant pipe may include a structure of being wound multiple times around a virtual center axis to include a spiral shape.

The virtual center axis of the coolant pipe may extend in a direction from the outdoor module toward the indoor module.

A virtual projection trajectory formed by an outer circumferential surface of the coolant pipe may include two line segments parallel to each other, a curved line connecting one end portions of the two line segments to each other, and another curved line connecting other end portions of the two line segments to each other.

A virtual projection trajectory formed by an outer circumferential surface of the coolant pipe may be oval.

The coolant pipe may include the first coolant pipe providing a flow path along which the coolant moved from the outdoor module to the indoor module, and the second coolant pipe providing a flow path along which the coolant moves from the indoor module to the outdoor module, and a virtual projection trajectory formed by the first coolant pipe may be greater than a virtual projection trajectory formed by the second coolant pipe.

The virtual projection trajectory of the second coolant pipe may be formed inside the virtual projection trajectory of the first coolant pipe.

The coolant pipe may include a metal pipe.

The window-type air-conditioner may further include a coil spring surrounding the coolant pipe having a spiral shape, and configured to prevent the coolant pipe from being broken when an interval between the outdoor module and the indoor module is adjusted.

The window-type air-conditioner may further include a first bracket fixing one end portion of the coolant pipe to the outdoor housing and a second bracket fixing the other end portion of the coolant pipe to the indoor housing.

The window-type air-conditioner may further include a temporary support portion supporting the indoor module and the outdoor module and removed before the window-type air-conditioner is installed on the window frame.

The pipe cover may include a bellows structure including a plurality of corrugations.

The window-type air-conditioner may further include a sealing member coupled to the pipe cover, and sealing between an outer circumferential surface of the pipe cover and the window frame on a plane perpendicular to a direction in which the pipe cover extends.

The sealing member may include an uneven portion corresponding to the plurality of corrugations of the pipe cover on a coupling surface in contact with the outer circumferential surface of the pipe cover.

The pipe cover may include a plurality of steps including different sizes and overlapping each other, and the overlapped steps may be configured to protrude outward or to be recessed as the interval between the outdoor module and the indoor module is adjusted.

A window-type air-conditioner according to an embodiment of the disclosure, as a window-type air-conditioner that is installable on a window frame, includes a compressor configured to compress a coolant, an outdoor heat exchanger configured to generate heat exchange between outdoor air and the coolant, and an outdoor housing accommodating the compressor and the outdoor heat exchanger, an indoor module including an indoor housing apart from the outdoor housing and an indoor heat exchanger arranged in the indoor housing and configured to generate heat exchange between indoor air and the coolant, a flexible coolant pipe a including a shape deformed as an interval between the outdoor module and the indoor module is adjusted and providing a flow path along which the coolant moves between the outdoor module and the indoor module, and a temporary support portion supporting the indoor module and the outdoor module and removed before the window-type air-conditioner is installed on the window frame.

The outdoor module and the indoor module may respectively include first coupling portions, configured to be fixed to the temporary support portion, and the temporary support portion may include a second coupling portion configured to be fixed to the outdoor module and the indoor module.

The temporary support portion may fix the indoor module and the outdoor module when the first coupling portions, and the second coupling portion are interlocked with each other.

Mode for Invention

Various embodiments of the disclosure and terms used therein are not intended to limit the disclosure to particular modes of practice, and it is to be appreciated that various modifications, equivalents, and/or alternatives that do not depart from the spirit and technical scope of the disclosure are encompassed in the disclosure.

Throughout the specification and drawings, like reference numerals may be used to denote like elements or components An expression used in a singular form in the specification also includes the expression in its plural form unless clearly specified otherwise in context.

In the specification, the expressions such as "A or B," "at least one of A and/or B," or "at least one or more of A and/or B" may include all available combinations of items listed together. For example, the expressions such as "A or B," "at least one of A and B," or "at least one of A or B" may signify all cases of including at least one A, including at least one B, or including both of at least one A and at least one B.

As used herein, the term "and/or" includes any and all combinations of one or more of the associated listed items.

Terms such as "first" and "second" are used herein merely to describe a variety of constituent elements, but the constituent elements are not limited by the terms. Such terms are used only for the purpose of distinguishing one constituent element from another constituent element.

In the specification, when a constituent element, e.g., a first constituent element, is "(operatively or communicatively) coupled with/to" or is "connected to" another constituent element, e.g., a second constituent element, the constituent element contacts or is connected to the other constituent element directly or through at least one of other constituent elements, e.g., a third constituent element.

In the specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

In the specification, when a constituent element "connects" or is "connected" to another constituent element, the constituent element contacts or is connected to the other constituent element directly or through at least one of other constituent elements.

It will be understood that when a component, such as a layer, a film, a region, or a plate, is referred to as being "on" another component, the component can be directly on the other component or intervening components may be present thereon.

According to an embodiment of the disclosure is a device performing functions, such as air-conditioning, ventilation, humidity control, cooling, heating, and the like, in an air-conditioning space (in the following description, referred to as the "indoor"), and mean devices having at least one of the functions.

According to an embodiment of the disclosure, the air-conditioner may include a heat pump device to performing a cooling function or a heating function. The heat pump device may have a refrigeration cycle in which a coolant circulates along a compressor, a first heat exchanger, an expansion device, and a second heat exchanger. All components of a heat pump device may be built into one housing that forms the exterior of an air-conditioner, or some components of a heat pump device may be divided and built into a plurality of housings.

An air-conditioner including a plurality of housings may include at least one outdoor unit installed outdoors and at least one indoor unit installed indoors. For example, an air-conditioner may be provided such that one outdoor unit and one indoor unit are connected to each other through a coolant pipe.

The outdoor unit may be electrically connected to the indoor unit. For example, information (or commands) to control an air-conditioner may be input through an input interface provided on the outdoor unit or indoor unit, and the outdoor unit and indoor unit may operate simultaneously or sequentially in response to a user input.

An air-conditioner may include an outdoor heat exchanger provided in the outdoor unit, an indoor heat exchanger provided in the indoor unit, and a coolant pipe connecting the outdoor heat exchanger and the indoor heat exchanger to each other.

The outdoor heat exchanger may perform heat exchange between the coolant and the outdoor air by using the phase change (e.g., evaporation or condensation) of the coolant. For example, while the coolant is condensed in the outdoor heat exchanger, the coolant radiates heat to the outdoor air, and while the coolant flowing in the outdoor heat exchanger evaporates, the coolant may absorb heat from the outdoor air.

Likewise, the indoor heat exchanger may perform heat exchange between the coolant and the indoor air by using the phase change (e.g., evaporation or condensation) of the coolant. For example, while the coolant evaporates in the indoor unit, the coolant may absorb heat from the indoor air, and the indoor can be cooled by blowing the indoor air cooled through the indoor heat exchanger that is cooled. Furthermore, while the coolant is condensed in the indoor heat exchanger, the coolant may release heat into the indoor air, and the indoor may be heated by blowing the indoor air heated through the indoor heat exchanger of a high temperature.

In other words, the air-conditioner performs a cooling or heating function through the phase change process of the coolant that circulates between the outdoor heat exchanger and the indoor heat exchanger. For this circulation of the coolant, the air-conditioner may include a compressor configured to compress the coolant. The compressor may suck a coolant gas through a suction portion and compress the coolant gas. The compressor may discharge a coolant gas of a high temperature and high pressure through a discharge portion. The compressor may be disposed in the outdoor unit.

The coolant may circulate, through the coolant pipe, in the order of the compressor, the outdoor heat exchanger, the expansion device, and the indoor heat exchanger, or in the order of the compressor, the indoor heat exchanger, the expansion device, and the outdoor heat exchanger.

The air-conditioner may include the expansion device to reduce the pressure of the coolant introduced into the heat exchanger. For example, the expansion device may be arranged inside the indoor unit or outdoor unit, or in both of the indoor unit and the outdoor unit.

The expansion device may reduce the temperature and pressure of the coolant by using, for example, a throttling effect. The expansion device may include an orifice for reducing the cross-sectional area of a flow path. The coolant having passed through the orifice may have reduced temperature and pressure.

The expansion device may be implemented as, for example, an electronic expansion valve capable of adjusting an opening ratio (the ratio of the cross-sectional area of a valve's flow path in a partially open state to the cross-sectional area of a valve's flow path in a fully open state). The amount of coolant passing through the expansion device may be controlled depending on the opening ratio of the electronic expansion valve.

The air-conditioner may include an accumulator. The accumulator may be connected to the suction portion of the compressor. The coolant of a low-temperature and low-pressure, which has evaporated in the indoor heat exchanger or the outdoor heat exchanger, may be introduced into the accumulator.

When a coolant in which coolant liquid and coolant gas are mixed is introduced into the accumulator, the accumulator may separate the coolant liquid from the coolant gas and provide the coolant gas, from which the coolant liquid is separated, to the compressor.

An outdoor fan may be provided around the outdoor heat exchanger. The outdoor fan may blow the outdoor air to the outdoor heat exchanger to facilitate heat exchange between the coolant and the outdoor air.

The outdoor unit of the air-conditioner may include at least one sensor. For example, the sensor of the outdoor unit may be provided as an environment sensor. The sensor of the outdoor unit may be arranged at a position inside or outside the outdoor unit. The sensor of the outdoor unit may include, for example, a temperature sensor for sensing the temperature of air around the outdoor unit, a humidity sensor for sensing the humidity of air around the outdoor unit, a coolant temperature sensor for sensing the temperature of the coolant in the coolant pipe passing through the outdoor unit, or a coolant pressure sensor for sensing the pressure of the coolant in the coolant pipe passing through the outdoor unit.

The outdoor unit of the air-conditioner may include an outdoor unit communication portion. The outdoor unit communication portion may receive a control signal from a controller of the indoor unit of the air-conditioner to be described below. The outdoor unit may control the operation of the compressor, the outdoor heat exchanger, the expansion device, a flow path switching valve, the accumulator, or the outdoor fan, based on the control signal received through the outdoor unit communication portion. The outdoor unit may transmit a sensing value detected by the sensor of the outdoor unit to the controller of the indoor unit through the outdoor unit communication portion.

The indoor unit of the air-conditioner may include a housing, an air blower for circulating air inside or outside the housing, and the indoor heat exchanger for performing heat exchange with the air introduced into the housing.

The housing may include an inlet. The indoor air may be introduced into the housing through the inlet.

The indoor unit of the air-conditioner may include a filter for filtering out foreign materials of the air introduced into the housing through the inlet.

The housing may include an outlet. The air flowing inside the housing may be discharged to the outside of the housing through the outlet.

An air flow guide for guiding the direction of the air discharged through the outlet may be provided in the housing of the indoor unit. For example, the air flow guide may include a blade located on the outlet. For example, the air flow guide may include an auxiliary fan for controlling the flow of the discharged air. The disclosure is not limited thereto, and the air flow guide may be omitted.

The indoor heat exchanger and the air blower may be arranged on a flow path connecting between the inlet and the outlet in the housing of the indoor unit.

The air blower may include an indoor fan and a fan motor. For example, the indoor fan may include an axial flow fan, a diagonal fan, a cross flow fan, and a centrifugal fan.

The indoor heat exchanger may be arranged between the air blower and the outlet, or between the inlet and the air blower. The indoor heat exchanger may absorb heat from the air introduced through the inlet, or transfer heat to the air introduced through the inlet. The indoor heat exchanger may include a heat exchange pipe in which the coolant flows, and a heat exchange fin abutting the heat exchange pipe to increase a heat transfer area.

The indoor unit of the air-conditioner may include a drain tray arranged under the indoor heat exchanger and collecting condensate generated in the indoor heat exchanger. The condensate accommodated in the drain tray may be drained to the outside through a drain hose. The drain tray may support the indoor heat exchanger.

The indoor unit of the air-conditioner may include an input interface. The input interface may include a certain type of a user input device including a button, a switch, a touch screen, and/or a touch pad. A user may directly input, through the input interface, setting data (e.g., a desired indoor temperature, operation mode setting of cooling/heating/dehumidification/air purification, outlet selection setting, and/or air volume setting).

The input interface may be connected to the external input device. For example, the input interface may be electrically connected to a wired remote controller. The wired remote controller may be installed at a particular position (e.g., a portion of a wall surface) of the indoor space. A user may input setting data about the operation of the air-conditioner by manipulating the wired remote controller. An electrical signal corresponding the setting data obtained through the wired remote controller may be transmitted to the input interface. Furthermore, the input interface may include an infrared sensor. A user may input setting data about the operation of an air-conditioner remotely by using the wireless remote controller. The setting data input through the wireless remote controller may be transmitted as an infrared signal to the input interface.

Furthermore, the input interface may include a microphone. A user's voice command may be obtained through the microphone. The microphone may convert the user's voice command into an electrical signal, and transmit the converted electrical signal to the controller of the indoor unit. The controller of the indoor unit may control the components of the air-conditioner to perform a function corresponding to the user's voice command. The setting data (e.g., a desired indoor temperature, operation mode setting of cooling/heating/dehumidification/air purification, outlet selection setting, and/or air volume setting) obtained through the input interface may be transmitted to the controller of the indoor unit described below. In an example, the setting data obtained through the input interface may be transmitted to the outside, that is, the outdoor unit or a server, through an indoor unit communication portion to be described below.

The indoor unit of the air-conditioner may include a power module. The power module may be connected to an external power and supply power to the components of the indoor unit.

The indoor unit of the air-conditioner may include a sensor of the indoor unit. The sensor of the indoor unit may be an environment sensor arranged in a space inside or outside the housing. For example, the sensor of the indoor unit may include one or more temperature sensors and/or humidity sensors arranged in a predetermined space inside or outside the housing of the indoor unit. For example, the sensor of the indoor unit may include a coolant temperature sensor for detecting the temperature of the coolant in the coolant pipe passing through the indoor unit. For example, the sensor of the indoor unit may include coolant temperature sensors respectively detecting temperatures of an entrance, a middle, and/or an exit of the coolant pipe passing through the indoor heat exchanger.

For example, environment information detected by the sensor of the indoor unit may be transmitted to the controller of the indoor unit to be described below, or to the outside through the indoor unit communication portion to be described below.

The indoor unit of the air-conditioner may include the indoor unit communication portion. The indoor unit communication portion may include at least one of a short-range communication module or a long-range communication module. The indoor unit communication portion may include at least one antenna for wirelessly communicating with other devices. The outdoor unit may include the outdoor unit communication portion. The outdoor unit communication portion may include at least one of a short-range communication module or a long-range communication module.

The short-range communication module may include a Bluetooth communication module, a Bluetooth low energy (BLE) communication module, a near field communication module, a WLAN (Wi-Fi) communication module, a Zigbee communication module, an infrared data association (IrDA) communication module, a WFD (Wi-Fi direct) communication module, an ultra-wide band (UWB) communication module, an Ant+ communication module, a microwave (uWave) communication module, and the like, but the disclosure is not limited thereto.

The long-range communication module may include communication modules for performing various types of long-range communications, and may include a mobile communication portion. The mobile communication portion may transceive a wireless signal with at least one of a base station, an external terminal, or a server, on a mobile communication network.

The indoor unit communication portion may communicate with an external device, such as a server, a mobile device, other home appliances, and the like, through a nearby access point (AP). The AP may connect a local area network (LAN) to which an air-conditioner or a user device is connected, to a wide area network (WAN) to which a server is connected. The air-conditioner or user device may be connected to the server through the WAN. The indoor unit of the air-conditioner may include the controller for controlling the components of the indoor unit including the air blower and the like. The outdoor unit of the air-conditioner may include the controller for controlling the components of the outdoor unit including the compressor and the like. The controller of the indoor unit may communicate with the controller of the unit controller through the indoor unit communication portion and the outdoor unit communication portion. The outdoor unit communication portion may transmit a control signal generated by the controller of the outdoor unit to the indoor unit communication portion, or a control signal transmitted from the indoor unit communication portion to the controller of the outdoor unit. In other words, the outdoor unit and the indoor unit may perform bi-directional communication. The outdoor unit and the indoor unit may transmit and receive various signals generated during the operation of the air-conditioner.

The controller of the outdoor unit may be electrically connected to the components of the outdoor unit, and may control the operation of each component. For example, the controller of the outdoor unit may adjust the frequency of the compressor, and control the flow path switching valve to switch the circulation direction of the coolant. The controller of the outdoor unit may adjust the rotation speed of the outdoor fan. Furthermore, the controller of the outdoor unit may generate a control signal to adjust a degree of opening of the expansion valve. Under the control of the controller of the outdoor unit, the coolant may circulate along a coolant circulation circuit including the compressor, the flow path switching valve, the outdoor heat exchanger, the expansion valve, and the indoor heat exchanger.

Various temperature sensors included in the outdoor unit and the indoor unit may transmit electrical signals corresponding to the respectively detected temperatures to the controller of the outdoor unit and/or the controller of the indoor unit. For example, the humidity sensors included in the outdoor unit and the indoor unit may transmit electrical signals corresponding to the respectively detected humidity to the controller of the outdoor unit and/or the controller of the indoor unit.

The controller of the indoor unit may obtain a user input from a user device including a mobile device and the like through the indoor unit communication portion, and obtain a user input directly through the input interface or through a remote controller. The controller of the indoor unit, in response to the received user input, may control the components of the indoor unit including the air blower and the like. The controller of the indoor unit may transmit information about the received user input to the controller of the outdoor unit.

The controller of the outdoor unit may control the components of the outdoor unit including the compressor and the like, based on the information about the user input received from the controller of the indoor unit. For example, when receiving from the indoor unit a control signal corresponding to a user input to select an operation mode, such as a cooling operation, a heating operation, an air blow operation, a defrost operation, or a dehumidification operation, the controller of the outdoor unit may control the components of the outdoor unit to perform the operation of the air-conditioner corresponding to the selected operation mode.

The controller of the outdoor unit and the controller of the indoor unit may each include a processor and a memory. For example, the controller of the indoor unit may include at least one first processor and at least one first memory, and the controller of the outdoor unit may include at least one second processor and at least one second memory.

The memory may memorize/store various pieces of information needed for the operation of the air-conditioner. The memory may store instructions, applications, data, and/or programs needed for the operation of the air-conditioner. For example, the memory may store various programs for a cooling operation, a heating operation, a dehumidification operation, and/or a defrost operation of the air-conditioner. The memory may include volatile memory, such as static random access memory (S-RAM), dynamic random access memory (D-RAM), and the like, to temporarily store data. Furthermore, the memory may include non-volatile memory, such as read only memory (ROM), erasable programmable read only memory (EPROM), electrically erasable programmable read only memory (EEPROM), and the like, to store data.

The processor may generate a control signal to control the operation of the air-conditioner, based on the instructions, applications, data, and/or programs stored in the memory. The processor may include, as hardware, a logic circuit and an arithmetic circuit. The processor may process data according to the programs and/or instructions provided from the memory, and generate a control signal according to a processing result. The memory and the processor may be implemented by one control circuit or a plurality of circuits.

The indoor unit of the air-conditioner may include an output interface. The output interface may be electrically connected to the controller of the indoor unit, and under the control of the controller of the indoor unit, may output information related to the operation of the air-conditioner. For example, the output interface may output information, such as an operation mode, a wind direction, an air volume, a temperature, and the like, selected by the user input. Furthermore, the output interface may output sensing information, a warning/error message, and the like, obtained from the sensor of the indoor unit or the sensor of the outdoor unit.

The output interface may include a display and a speaker. The speaker, as a sound device, may output various types of sound. The display may display information input by a user or information provided to a user, with various graphics elements. For example, information about the operation of the air-conditioner may be displayed as at least one of an image or text. Furthermore, the display may include an indicator for providing particular information. The display may include a liquid crystal display (LCD) panel, a light-emitting diode (LED) panel, an organic light-emitting diode (OLED) panel, a micro LED panel, and/or a plurality of LEDs.

According to an embodiment of the disclosure is described below in detail with reference to the accompanying drawings.

FIG. 1 is a view illustrating that a window-type air-conditioner according to an embodiment of the disclosure is installed on a window frame.

Referring to FIG. 1, the window-type air-conditioner 10 according to an embodiment of the disclosure may be installed on a window frame 1 and may perform a function to provide indoor cooling. The window frame 1 on which the window-type air-conditioner 10 is installed may be a frame that support a window 11 to be slidably moved.

The window-type air-conditioner 10 may include an outdoor module 20 and an indoor module 30. The outdoor module 20 may be located outdoor with respect to the window frame 1. The indoor module 30 may be located indoor with respect to the window frame 1.

Figure 2:
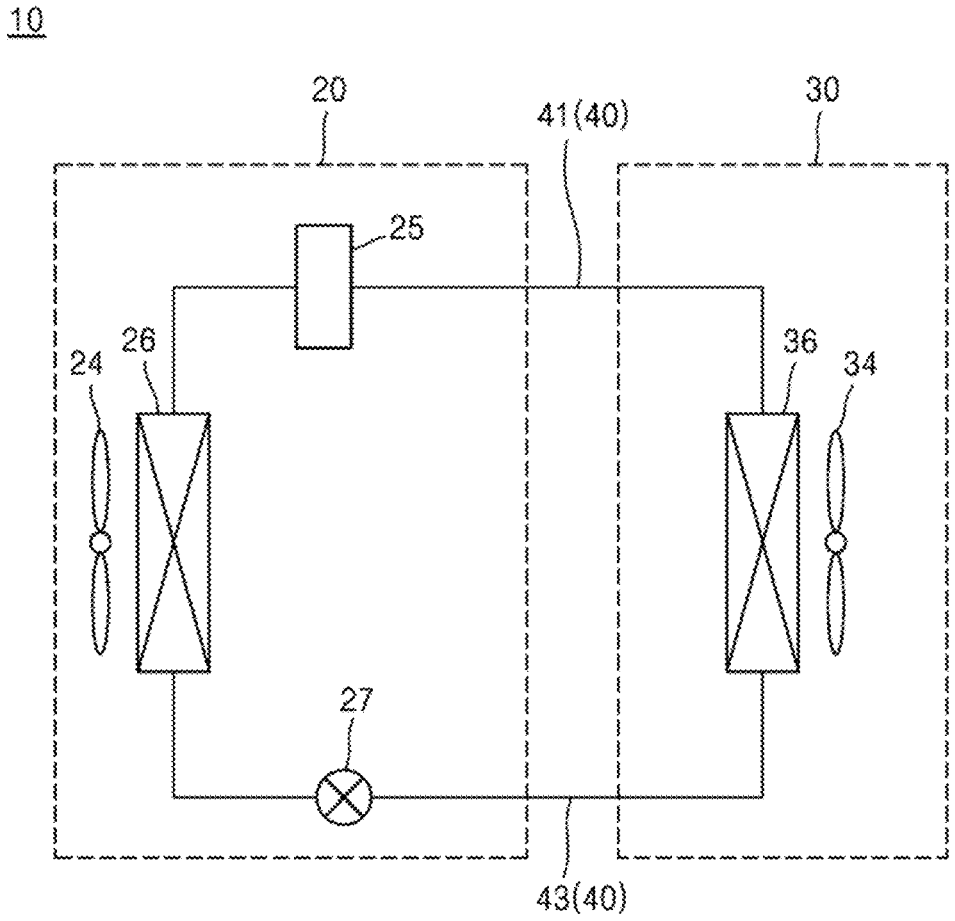
FIG. 2 is a conceptual view of the configuration of a window-type air-conditioner according to an embodiment of the disclosure.

FIG. 2 is a conceptual view of the configuration of a window-type air-conditioner according to an embodiment of the disclosure.

Referring to FIG. 2, the window-type air-conditioner 10 according to an embodiment of the disclosure may include a compressor 25, an outdoor heat exchanger 26, an expander 27, and an indoor heat exchanger 36.

The compressor 25 may compress a coolant. The compressor 25 may compress a coolant in a gas state. The coolant in a gas state may be converted from a low-temperature and low-pressure state to a high-temperature and high-pressure state, in a process of being compressed by the compressor 25.

Heat exchange between the coolant and the outdoor air may be generated in the outdoor heat exchanger 26. The outdoor heat exchanger 26 and the compressor 25 may be connected to each other such that the coolant is movable. The high-temperature and high-pressure coolant received from the compressor 25 may be condensed in the outdoor heat exchanger 26, and while condensed, the coolant may radiate heat to the outdoor air.

An outdoor fan 24 may be provided in the vicinity of the outdoor heat exchanger 26. The outdoor fan 24 may blow the outdoor air to the outdoor heat exchanger 26 to facilitate the heat exchange between the coolant and the outdoor air.

The expander 27 may lower the pressure and temperature of the coolant condensed in the outdoor heat exchanger 26. The expander 27 and the outdoor heat exchanger 26 may be connected to each other such that the coolant is movable. For example, the expander 27 may lower the pressure and temperature of the coolant by using a throttling effect. For example, the expander 27 may lower the pressure and temperature of the coolant by using an orifice.

Heat exchange between the coolant and the indoor air may be generated in the indoor heat exchanger 36. The indoor heat exchanger 36 and the expander 27 may be connected to each other such that the coolant is movable. The low-temperature and low-pressure coolant may evaporate in the indoor heat exchanger 36. While evaporating, the coolant may absorb heat from the indoor air.

An indoor fan 34 may be provided in the vicinity of the indoor heat exchanger 36. The indoor fan 34 may blow the indoor air to the indoor heat exchanger 36 to facilitate the heat exchange between the coolant and the indoor air.

The coolant passing through the indoor heat exchanger 36 may be in a low-temperature and low-pressure state. The low-temperature and low-pressure coolant may be transferred to the compressor 25. Accordingly, the process described above may be repeated.

As described above, while the window-type air-conditioner 10 is in operation, the coolant moves along a coolant pipe 40, and the indoor air may be cooled in a process in which the coolant evaporates in the indoor heat exchanger 36, and heat is radiated in a process in which the coolant condenses in the outdoor heat exchanger 26.

The coolant pipe 40 may provide a flow path along which the coolant moves between the outdoor module 20 and the indoor module 30. The coolant pipe 40 may include a metal material. The coolant pipe 40 may be a metal pipe. However, the material of the coolant pipe 40 is not limited to metal.

The coolant pipe 40 may include a first coolant pipe 41 connecting between the compressor 25 and the indoor heat exchanger 36, and a second coolant pipe 43 connecting between the outdoor heat exchanger 26 and the indoor heat exchanger 36.

The first coolant pipe 41 may be a low pressure pipe. A low-pressure gas coolant may be transferred through the first coolant pipe 41. The indoor heat exchanger 36 may transfer a low-pressure gas coolant to the compressor 25 through the first coolant pipe 41. The second coolant pipe 43 may be a high-pressure pipe. A high-pressure liquid coolant may be transferred to the outdoor heat exchanger 26 through the second coolant pipe 43. The outdoor heat exchanger 26 may transfer a high-pressure liquid coolant to the indoor heat exchanger 36 through the second coolant pipe 43. However, the pressure and phase of the coolant transferred through the first coolant pipe 41 and the second coolant pipe 43 are not limited thereto. For example, the second coolant pipe 43 may be configured to transfer a low-pressure coolant according to the arrangement position of the expander 27 on the window-type air-conditioner 10. For example, while the first coolant pipe 41 may be configured to transfer a high-pressure coolant, the second coolant pipe 43 may be configured to transfer a low-pressure coolant.

During the operation of the window-type air-conditioner 10, noise may occur from some components, and when the noise is transferred to a user, it may cause inconvenience to the user. For example, during the operation of the window-type air-conditioner 10, loud noise may occur in a process in which the compressor 25 compresses the coolant at high pressure. When the noise occurs in the compressor 25 is transferred to a user, it may cause inconvenience to the user.

The window-type air-conditioner 10 according to an embodiment of the disclosure may have a structure to separate the outdoor module 20 including the compressor 25 from the indoor module 30, to prevent the noise occurring from the compressor 25 from entering the indoor space.

Figure 3:
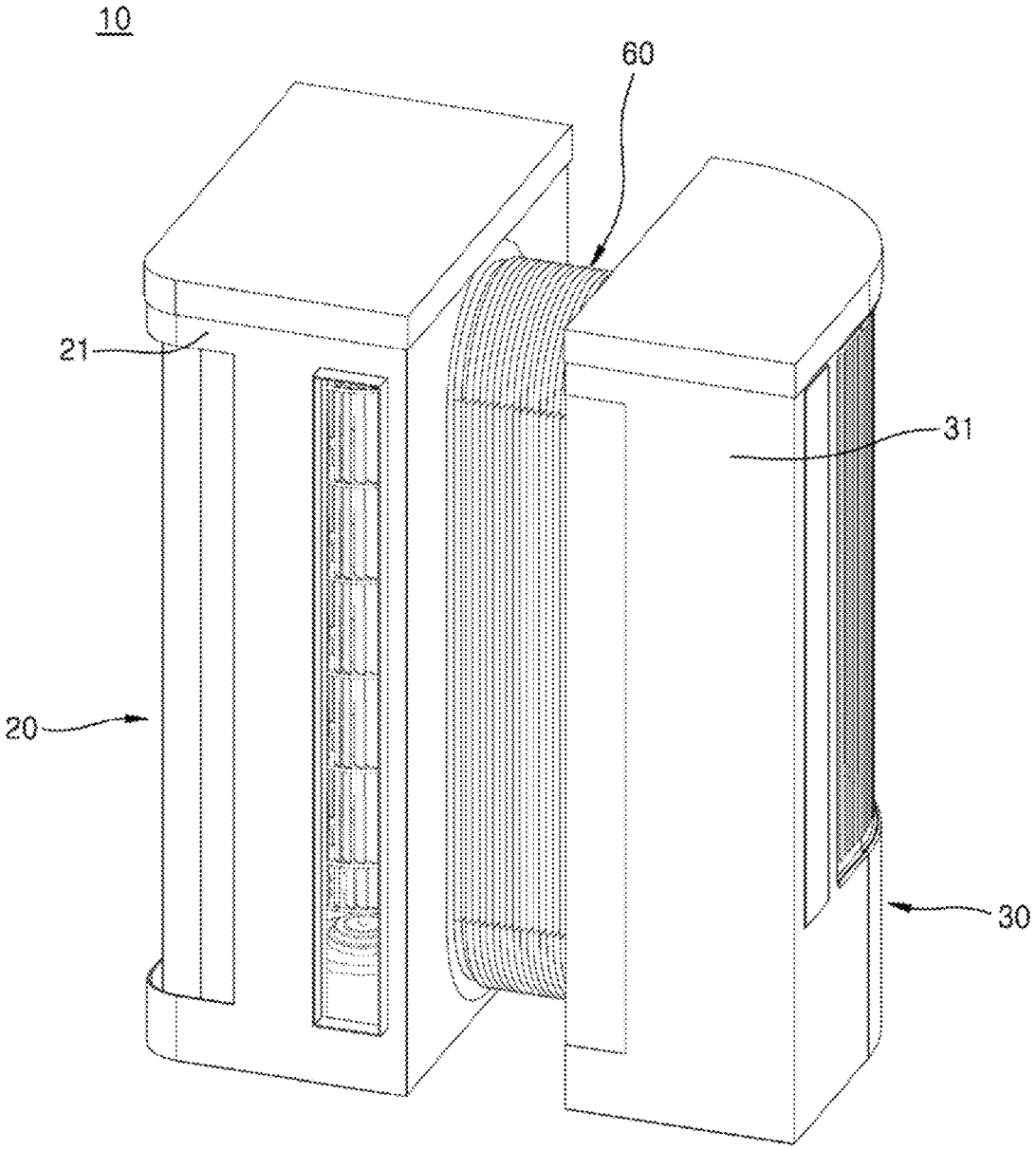
FIG. 3 is a perspective view of a window-type air-conditioner according to an embodiment of the disclosure.
Figure 4:
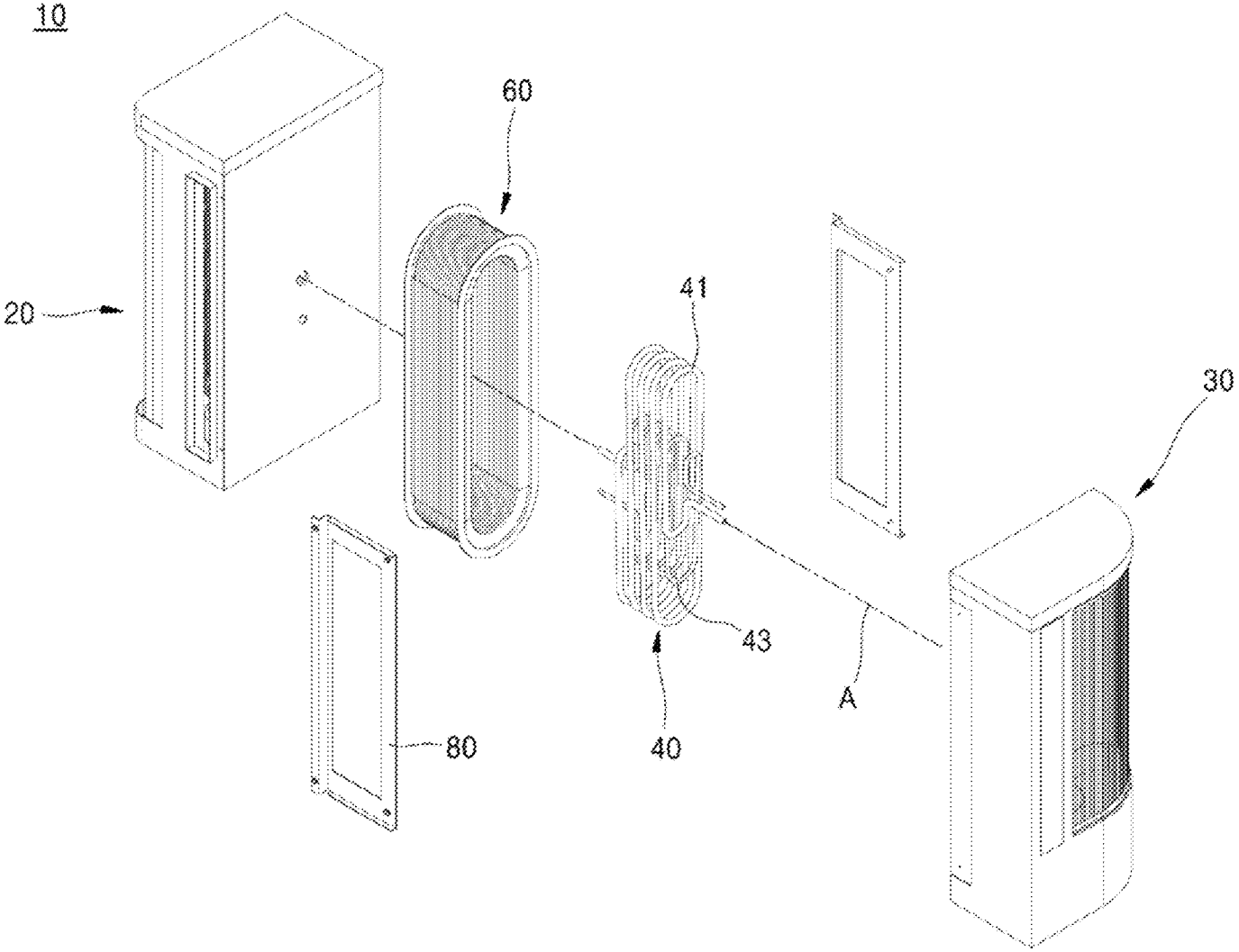
FIG. 4 is an exploded perspective view of a window-type air-conditioner according to an embodiment of the disclosure.

FIG. 3 is a perspective view of a window-type air-conditioner according to an embodiment of the disclosure. FIG. 4 is an exploded perspective view of a window-type air-conditioner according to an embodiment of the disclosure.

Referring to FIGS. 2 to 4, the window-type air-conditioner 10 according to an embodiment of the disclosure may include the outdoor module 20, the indoor module 30 separated from the outdoor module 20, the coolant pipe 40 providing a flow path through which a coolant moved between the outdoor module 20 and the indoor module 30 that are separated from each other, and a pipe cover 60 accommodating the coolant pipe 40.

The outdoor module 20 may include an outdoor housing 21. The outdoor housing 21 may accommodate the compressor 25 and the outdoor heat exchanger 26. The indoor module 30 may include an indoor housing 31. The indoor housing 31 may accommodate the indoor fan 34 and the indoor heat exchanger 36. Although FIGS. 3 and 4 do not illustrate the expander 27, the expander 27 may be accommodated in the outdoor housing 21 or the indoor housing 31.

The outdoor housing 21 may be separated from the indoor housing 31. The outdoor housing 21 may be apart from the indoor housing 31.

Referring to FIGS. 1 to 4, when the window-type air-conditioner 10 according to an embodiment of the disclosure is installed on the window frame 1, the window-type air-conditioner 10 having a structure to separate the outdoor module 20 and the indoor module 30 from each other may prevent noise from entering the indoor space. When the window-type air-conditioner 10 is installed on the window frame 1 by separating the outdoor module 20 and the indoor module 30 of the window-type air-conditioner 10 from each other, the window 11 can be closed further than the other case in which the outdoor module 20 and the indoor module 30 of the window-type air-conditioner 10 are not separated from each other. When the window-type air-conditioner 10 is installed on the window frame 1 and the window 11 is closed further, noise entering the indoor space may be prevented.

The thickness of the window frame 1 on which the window-type air-conditioner 10 according to an embodiment of the disclosure is installed, or the thickness of the window 11, may be various. When the window-type air-conditioner 10 is installed on the window frame 1, a distance between the outdoor module 20 and the indoor module 30 for efficient installation according to the thickness of the window frame 1 may vary.

Considering this point, the window-type air-conditioner 10 according to an embodiment of the disclosure may provide a structure to variably adjust the distance between the outdoor module 20 and the indoor module 30. Accordingly, the window-type air-conditioner 10 according to an embodiment of the disclosure may be installed on the window frame 1 having various thicknesses.

Figure 5A:
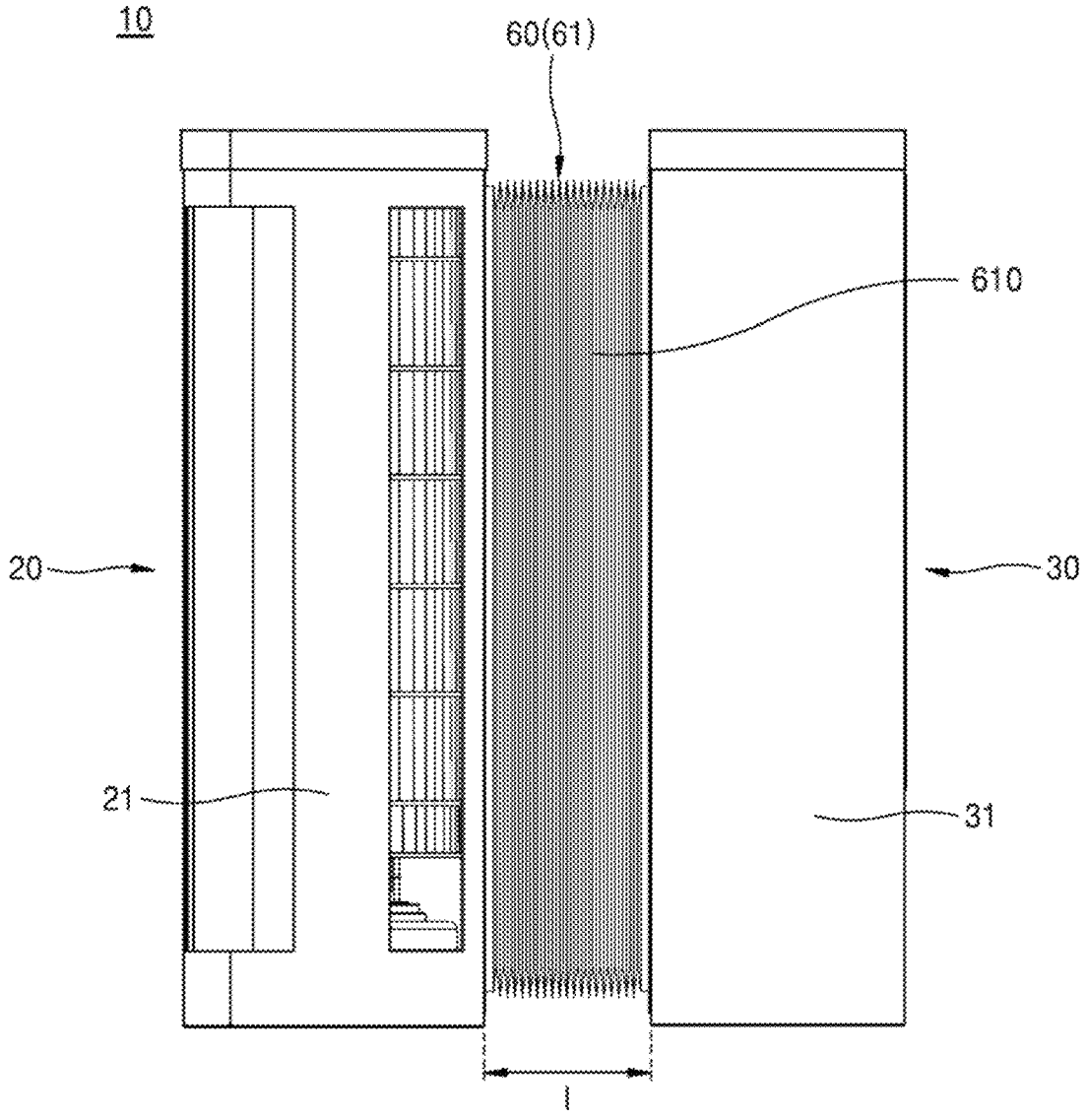
FIGS. 5A and 5B are views for describing when an interval between an outdoor module and an indoor module is relatively narrow in a window-type air-conditioner according to an embodiment of the disclosure.
Figure 5B:
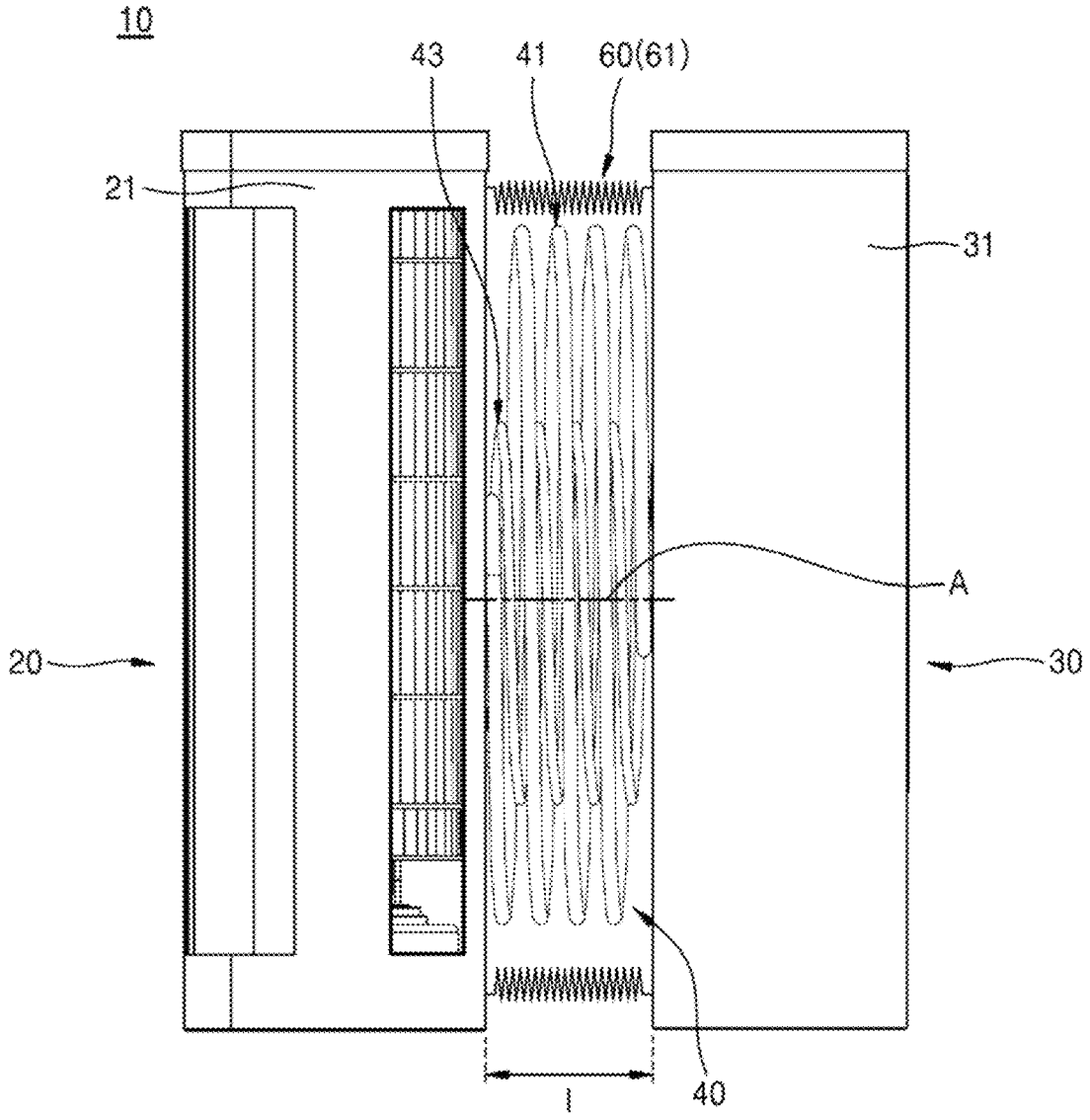
Figure 6A:
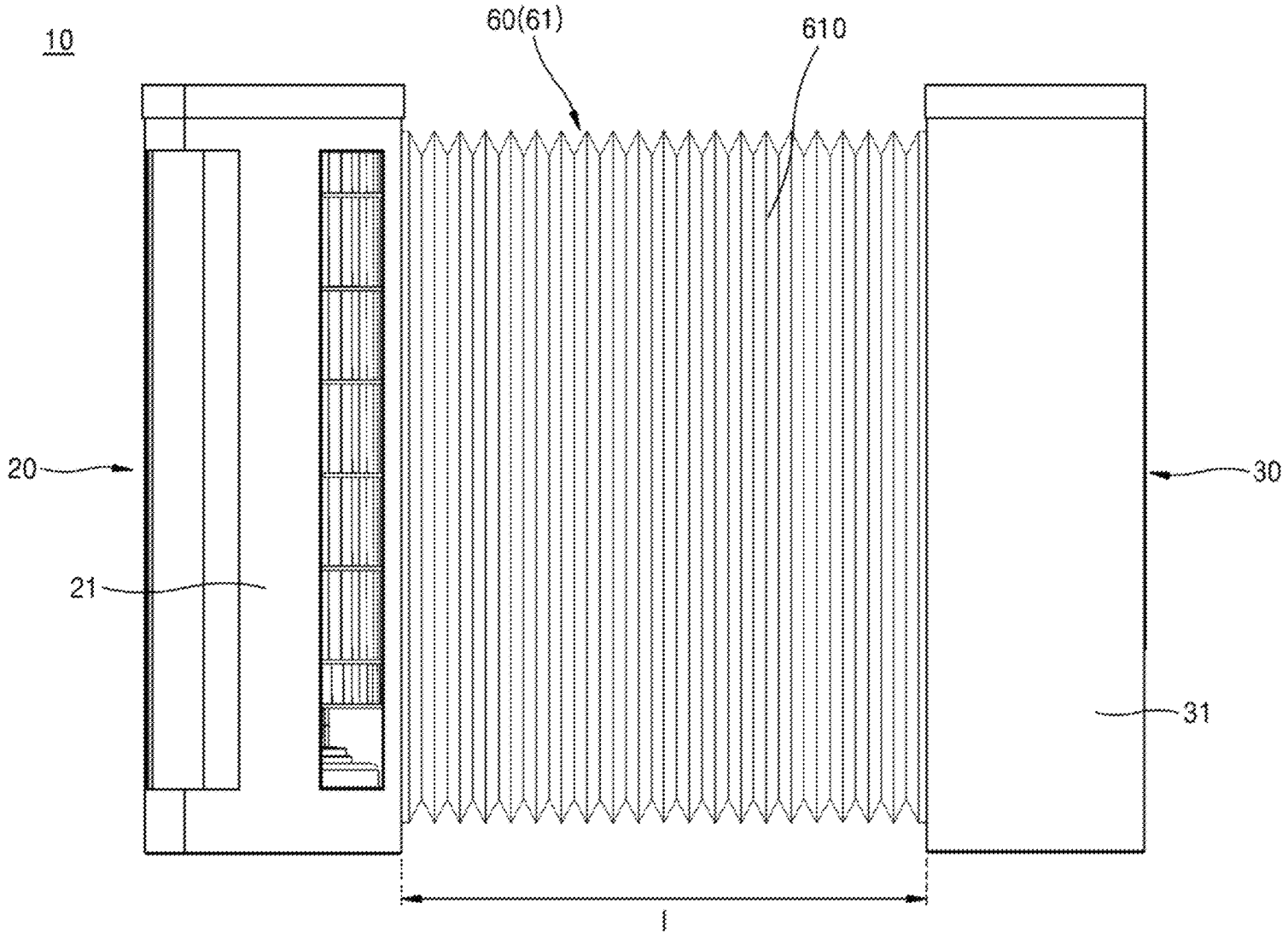
FIGS. 6A and 6B are views for describing when the interval between an outdoor module and an indoor module is relatively large in a window-type air-conditioner according to an embodiment of the disclosure.
Figure 6B:
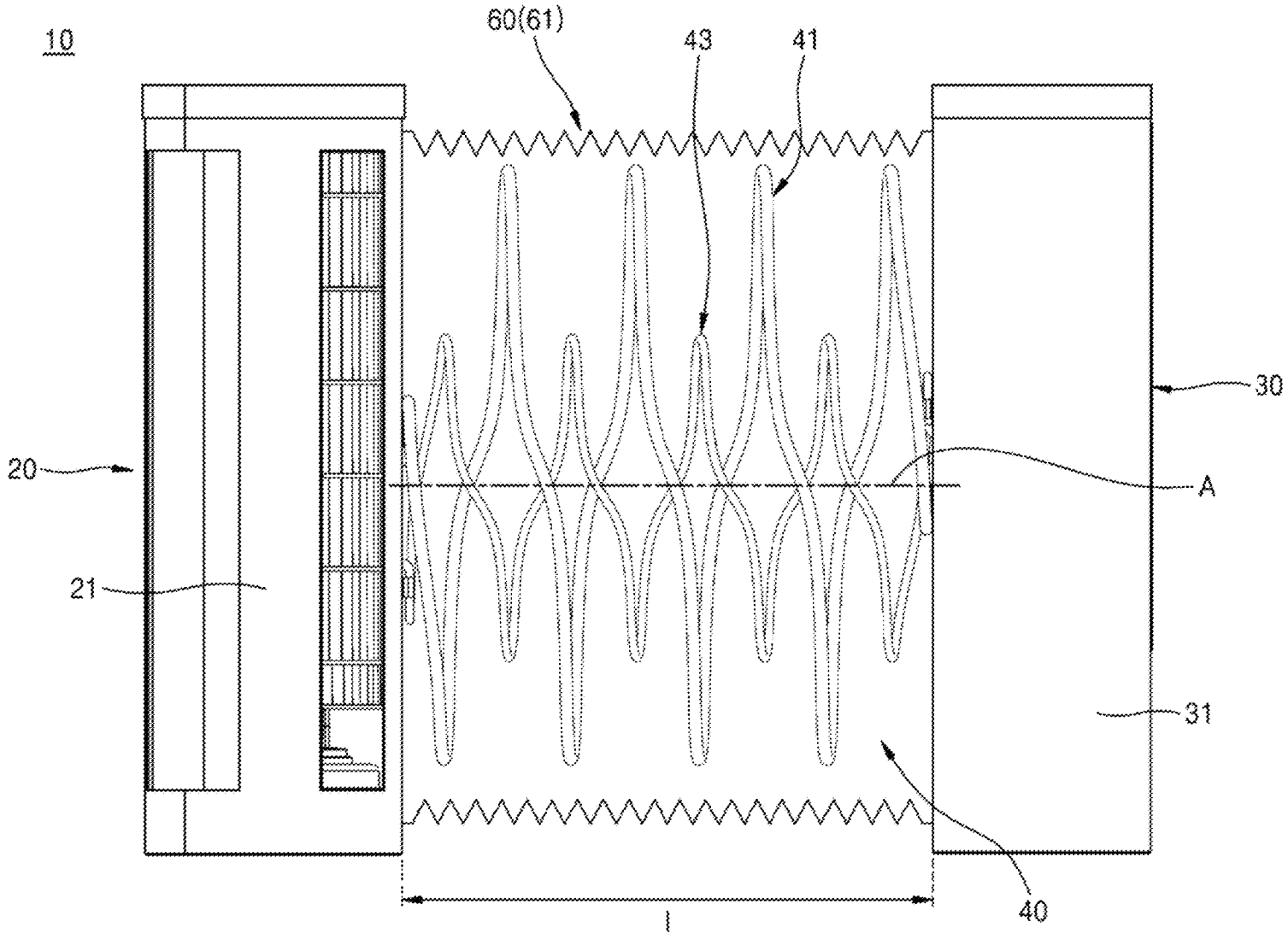

FIGS. 5A and 5B are views for describing when an interval between an outdoor module and an indoor module is relatively narrow in a window-type air-conditioner according to an embodiment of the disclosure, and FIGS. 6A and 6B are views for describing when the interval between the outdoor module 20 and the indoor module 30 is relatively large in a window-type air-conditioner according to an embodiment of the disclosure. FIG. 5B is a partially cut-away side view of the pipe cover of the window-type air-conditioner of FIG. 5A, and FIG. 6B is a partially cut-away side view of the pipe cover of the window-type air-conditioner of FIG. 6A.

Referring to FIGS. 5A to 6B, the window-type air-conditioner 10 according to an embodiment of the disclosure may be configured to adjust an interval I between the outdoor module 20 and the indoor module 30. For example, the window-type air-conditioner 10 may include the coolant pipe 40 and the pipe cover 60 that are configured to adjust the interval I between the outdoor module 20 and the indoor module 30.

For example, the coolant pipe 40 may have a spiral shape so as to adjust the interval between the outdoor module 20 and the indoor module 30. The coolant pipe 40 may include a metal material. However, the material of the coolant pipe 40 is not limited to metal. When the coolant pipe 40 has a spiral shape, the material of the coolant pipe 40 may be freely selected. For example, a relatively inexpensive metal material may be selected as the material of the coolant pipe 40. In other words, a relatively expensive flexible material may not be selected as the material of the coolant pipe 40. When a metal material is selected for the coolant pipe 40, leakage of the coolant may be prevented. The coolant pipe 40 may include a metal alloy material of a single layer structure. The metal alloy material may selectively include stainless, carbon, chromium, copper, nickel, and manganese. In an embodiment of the disclosure, although a metal material is example as the material of the coolant pipe 40, the material of the coolant pipe 40 is not limited thereto.

In the window-type air-conditioner 10 according to an embodiment of the disclosure, even when the coolant pipe 40 includes a metal material, the interval I between the outdoor module 20 and the indoor module 30 is adjustable. When the coolant pipe 40 has a spiral shape, even when the coolant pipe 40 is a metal pipe, the interval I between the outdoor module 20 and the indoor module 30 is adjustable. As described above, in the window-type air-conditioner 10 according to an embodiment of the disclosure, as the coolant pipe 40 has a spiral shape and uses a metal material, the interval between the outdoor module 20 and the indoor module 30 may be adjustable and also the cost for the coolant pipe 40 may be reduced.

A virtual center axis A connecting between the outdoor module 20 and the indoor module 30 of the window-type air-conditioner 10 according to an embodiment of the disclosure may exist. The virtual center axis A may extend in a direction from the outdoor module 20 to the indoor module 30. The virtual center axis A may be parallel with the interval I between the outdoor module 20 and the indoor module 30. The virtual center axis A may be arranged at a certain angle with respect to the interval I between the outdoor module 20 and the indoor module 30.

The coolant pipe 40 may have a structure of being wound multiple times around the virtual center axis A to have a spiral shape. The coolant pipe 40 may have a spiral shape of winding three or four times around the virtual center axis A. However, the shape of the coolant pipe 40 is not limited thereto. For example, the coolant pipe 40 may be wound less than three times around the virtual center axis A. For example, the coolant pipe 40 may be wound four or more times around the virtual center axis A.

The first coolant pipe 41 and the second coolant pipe 43 may each independently have a structure of being wound multiple times around the virtual center axis A to have a spiral shape. The first coolant pipe 41 and the second coolant pipe 43 may each have a spiral shape of being wound three or four times around the virtual center axis A. However, the shapes of the first coolant pipe 41 and the second coolant pipe 43 are not limited thereto. For example, the first coolant pipe 41 and the second coolant pipe 43 may each be wound multiple times around different virtual center axes to have a spiral shape.

The first coolant pipe 41 and the second coolant pipe 43 may have different pipe diameters. In other words, the pipe thicknesses of the first coolant pipe 41 and the second coolant pipe 43 may be different from each other. The pipe thickness of the first coolant pipe 41 may be greater than the pipe thickness of the second coolant pipe 43. However, the thickness of the coolant pipe 40 is not limited thereto.

The spiral shapes of the first coolant pipe 41 and the second coolant pipe 43 wound around the virtual center axis A may be different from each other. The spiral shape of first coolant pipe 41 wound around the virtual center axis A may be greater than the spiral shape of the second coolant pipe 43 wound around the virtual center axis A. In other words, the spiral shape of the second coolant pipe 43 wound around the virtual center axis A may exist inside the spiral shape of the first coolant pipe 41 wound around the virtual center axis A. In other words, the outside of the spiral shape of the second coolant pipe 43 wound around the virtual center axis A may be covered by the spiral shape of the first coolant pipe 41 wound around the virtual center axis A. In other words, the first coolant pipe 41 may be wound around the virtual center axis A in a spiral shape with a radius greater than that of the second coolant pipe 43. However, the shapes of the first coolant pipe 41 and the second coolant pipe 43 both wound around the virtual center axis A are not limited thereto.

The pipe cover 60 may connect the indoor module 30 and the outdoor module 20 to each other so as to accommodate the coolant pipe 40 and allow adjustment of the interval I between the outdoor module 20 and the indoor module 30. The pipe cover 60 may provide insulation to the coolant pipe 40. Both end portions of the pipe cover 60 may be respectively fixed to the outdoor module 20 and the indoor module 30. The pipe cover 60 may have a bellows structure 61 having a plurality of corrugations 610. The bellows structure 61 may enable the adjustment of the length of the pipe cover 60 accordingly as the corrugations 610 are unfolded or folded.

In the following description, the interval I between the outdoor module 20 and the indoor module 30 is adjusted in the window-type air-conditioner 10 according to the embodiment described above of the disclosure is described.

Referring to FIG. 1 and FIGS. 5B to 6B, in a process of installing a window-type air-conditioner according to an embodiment of the disclosure, the interval between the outdoor module 20 and the indoor module 30 may be adjusted depending on the thickness of the window frame 1. For example, when the thickness of the window frame 1 is relatively small, the interval I between the outdoor module 20 and the indoor module 30 may be adjusted to be relatively narrow. For example, when the thickness of the window frame 1 is relatively large, the interval I between the outdoor module 20 and the indoor module 30 may be adjusted to be relatively wide.

Referring to FIGS. 5A and 5B, when the interval between the outdoor module 20 and the indoor module 30 decreases, the corrugations of the pipe cover 60 are folded so that the coolant pipe 40 having a spiral shape is compressed to be compact. When the interval between the outdoor module 20 and the indoor module 30 of the window-type air-conditioner 10 according to an embodiment of the disclosure decreases, ridges formed by the coolant pipe 40 having a spiral shape with respect to the virtual center axis A may be closer to each other. When the interval between the outdoor module 20 and the indoor module 30 of the window-type air-conditioner 10 according to an embodiment of the disclosure decreases, the shapes formed to repeat at a certain pitch with respect to the virtual center axis A may be adjacent to each other. When the interval between the outdoor module 20 and the indoor module 30 of the window-type air-conditioner 10 according to an embodiment of the disclosure decreases, the certain pitch may be decreased.

Referring to FIGS. 6A and 6B, when the interval between the outdoor module 20 and the indoor module 30 increases, the corrugations of the pipe cover 60 are unfolded so that the coolant pipe 40 having a spiral shape expands along the virtual center axis A. When the interval between the outdoor module 20 and the indoor module 30 of the window-type air-conditioner 10 according to an embodiment of the disclosure increases, the ridges formed by the coolant pipe 40 having a spiral shape with respect to the virtual center axis A may be away from each other. When the interval between the outdoor module 20 and the indoor module 30 of the window-type air-conditioner 10 according to an embodiment of the disclosure increases, the shapes formed to repeat at a certain pitch with respect to the virtual center axis A may be away from each other. When the interval between the outdoor module 20 and the indoor module 30 of the window-type air-conditioner 10 according to an embodiment of the disclosure increases, the certain pitch may be increased. The certain pitch may be a certain distance located on the interval I between the outdoor module 20 and the indoor module 30.

Figure 7A:
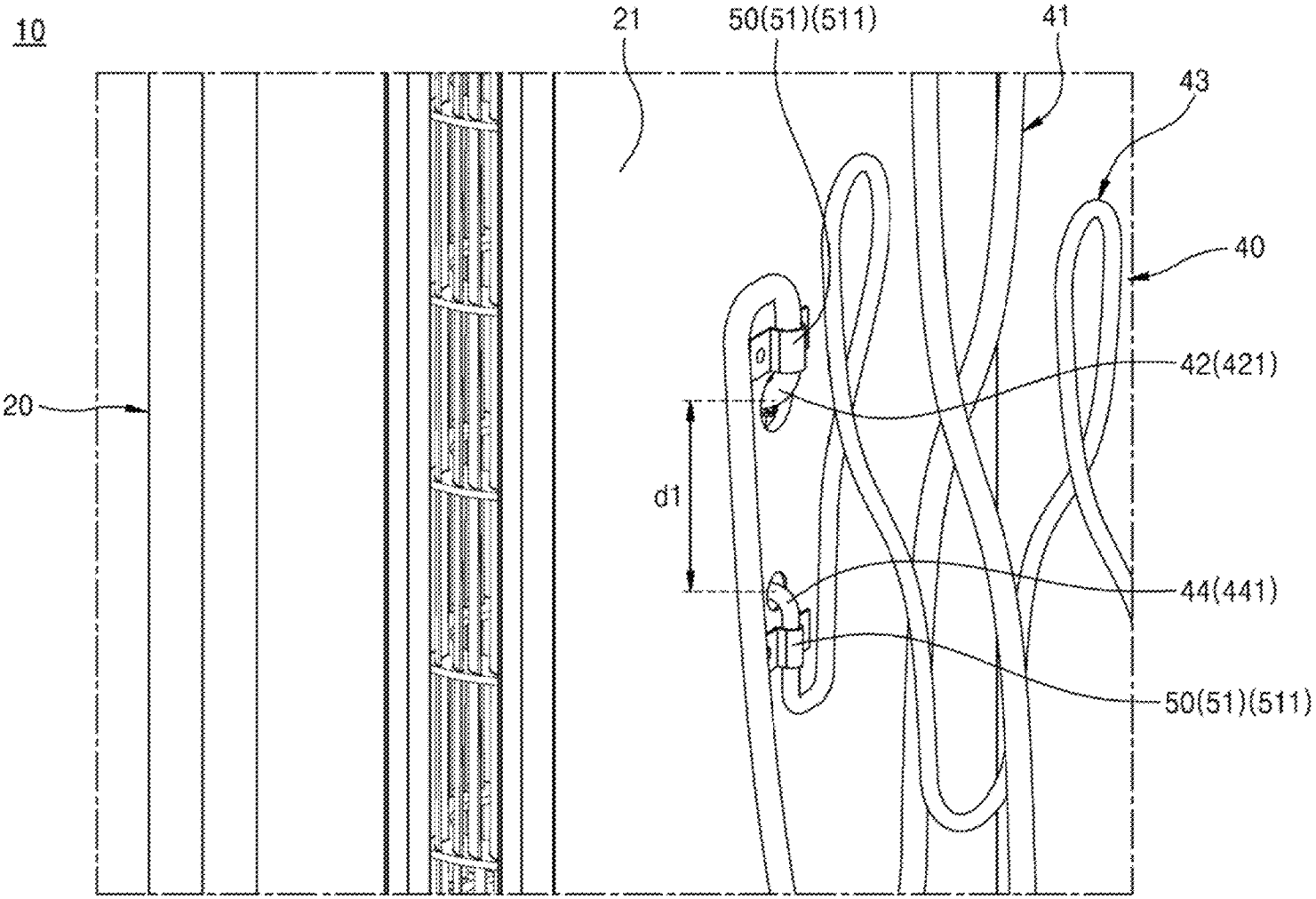
FIGS. 7A and 7B are views for describing a pipe support member of a window-type air-conditioner according to an embodiment of the disclosure.
Figure 7B:
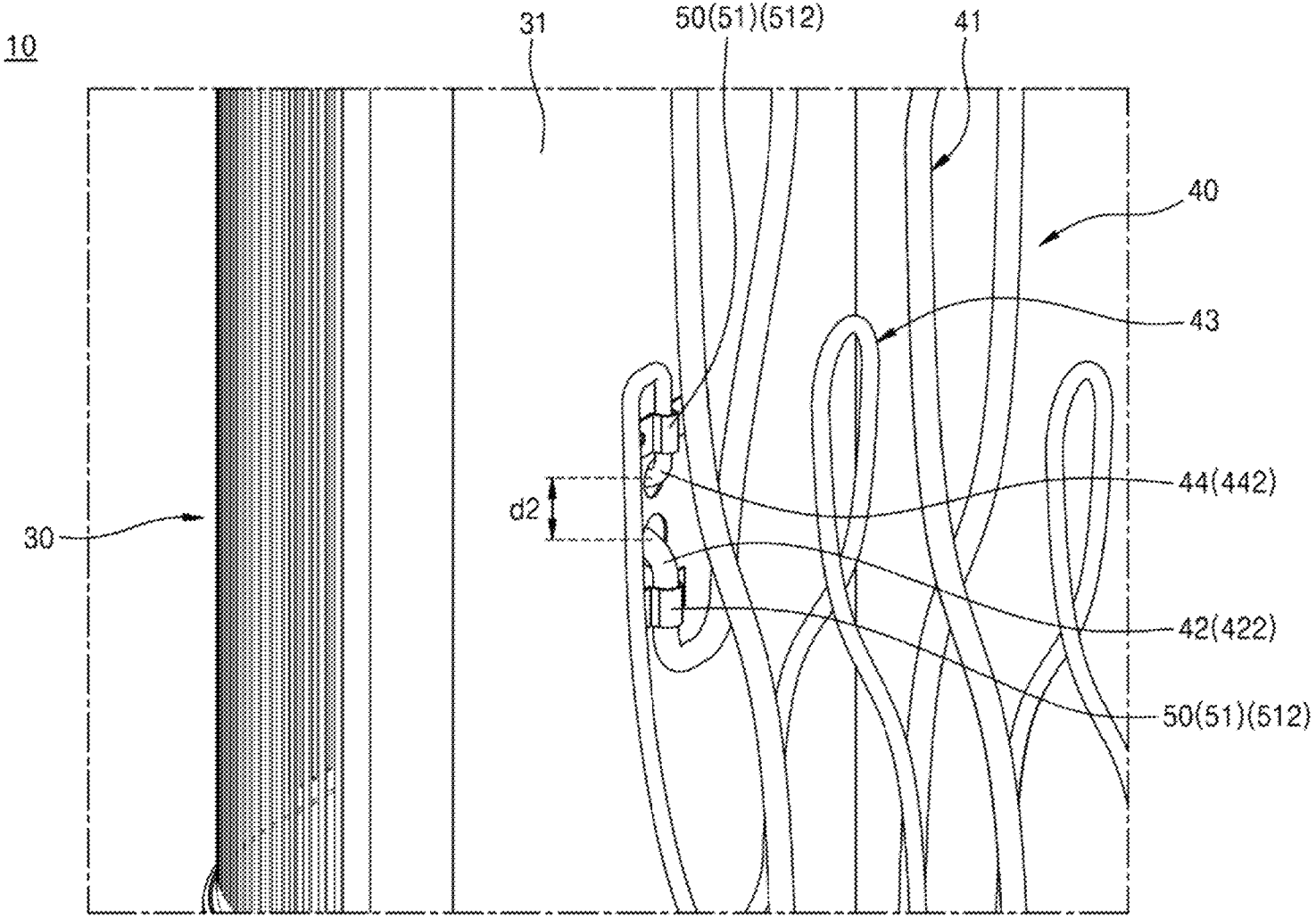

FIG. 7A is a view for describing a pipe support member of a window-type air-conditioner according to an embodiment of the disclosure. FIG. 7B is a view for describing a pipe support member of a window-type air-conditioner according to an embodiment of the disclosure.

Referring to FIGS. 7A and 7B, the window-type air-conditioner 10 according to an embodiment of the disclosure may include a pipe support member 50 for supporting the coolant pipe 40. The pipe support member 50 may include a plurality of brackets 51 configured to support a portion where the coolant pipe 40 is connected to the outdoor module 20 and the indoor module 30.

The brackets 51 may include a first bracket 511 configured to fix the coolant pipe 40 to the outdoor module 20. The brackets 51 may include a second bracket 512 configured to fix the coolant pipe 40 to the indoor module 30. The first bracket 511 may fix one end portion of the coolant pipe 40 to the outdoor housing 21, and the second bracket 512 may fix the other end portion of the coolant pipe 40 to the indoor housing 31.

The first coolant pipe 41 may be connected to the outdoor module 20 and the indoor module 30 through a first coolant pipe connection portion 42. The first coolant pipe 41 may be connected to the outdoor module 20 through a first connection portion 421. The first coolant pipe 41 may be connected to the indoor module 30 through a second connection portion 422.

The second coolant pipe 43 may be connected to the outdoor module 20 and the indoor module 30 through a second coolant pipe connection portion 44. The second coolant pipe 43 may be connected to the outdoor module 20 through a third connection portion 441, and the second coolant pipe 43 may be connected to the indoor module 30 through a fourth connection portion 442.

The first coolant pipe connection portion 42 and the second coolant pipe connection portion 44 may each be bendable to connect the coolant pipe 40 to the outdoor module 20 and the indoor module 30.

Referring to FIG. 5A to FIG. 7B, when the shape of the coolant pipe 40 is changed as the interval I between the outdoor module 20 and the indoor module 30 is adjusted, an excessive force may act on the first coolant pipe connection portion 42 and the second coolant pipe connection portion 44.

The first bracket 511 may fix the first connection portion 421 and the third connection portion 441 to the outdoor module 20. When the shape of the coolant pipe 40 is changed as the interval I between the outdoor module 20 and the indoor module 30 is adjusted, the first bracket 511 may prevent an excessive force from acting on the first connection portion 421 and the third connection portion 441.

The second bracket 512 may fix the first connection portion 421 and the third connection portion 441 to the indoor module 30. When the shape of the coolant pipe 40 is changed as the interval I between the outdoor module 20 and the indoor module 30 is adjusted, the second bracket 512 may prevent an excessive force from acting on the second connection portion 422 and the fourth connection portion 442.

A distance d1 between the first connection portion 421 and the third connection portion 441 on the outdoor housing 21 may be greater than a distance d2 between the fourth connection portion 442 and the second connection portion 422 on the indoor housing 31. However, the arrangement of the first connection portion 421, the second connection portion 422, the third connection portion 441, and the fourth connection portion 442 is not limited thereto.

Figure 8A:
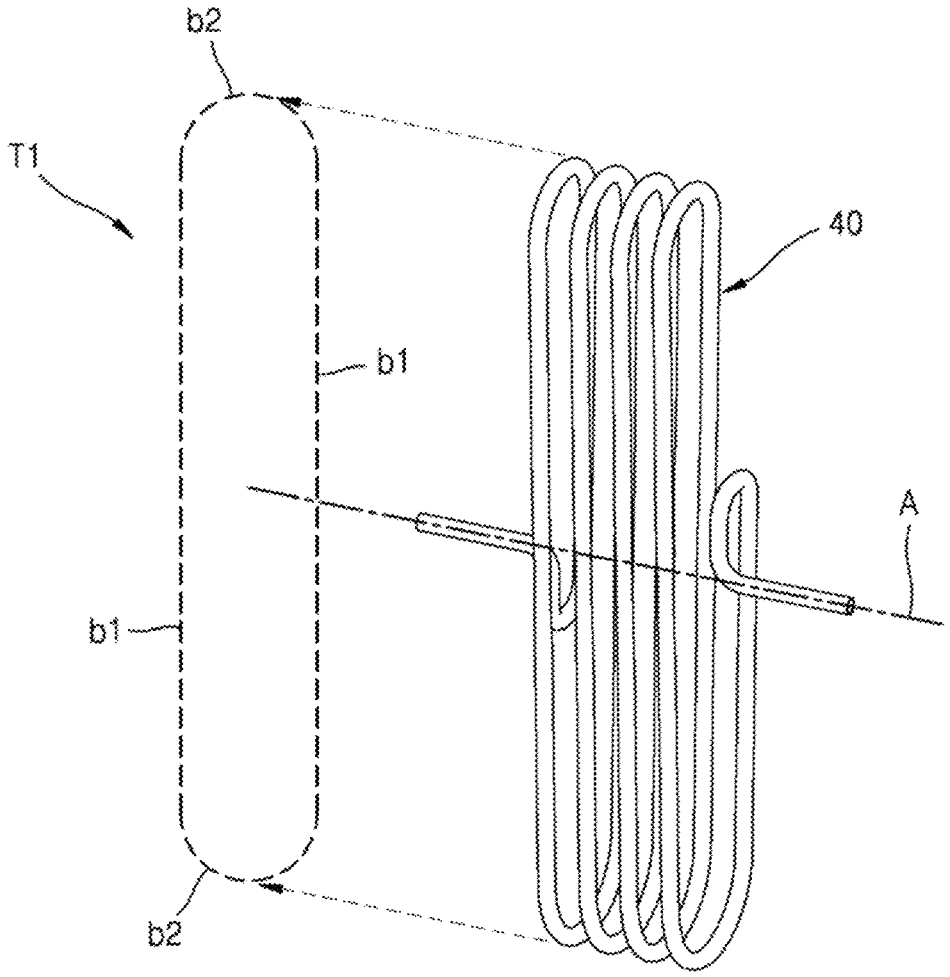
FIGS. 8A and 8B are views showing a virtual projection trajectory of a coolant pipe according to an embodiment of the disclosure.
Figure 8B:
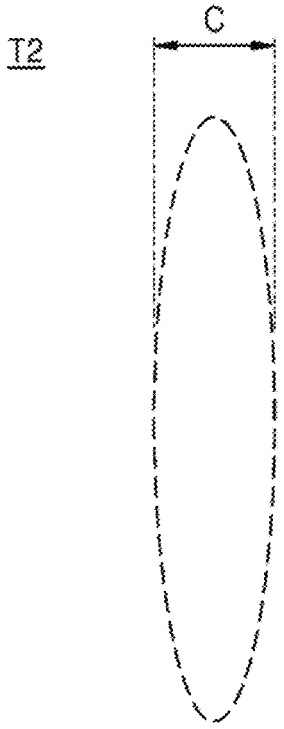
Figure 9:
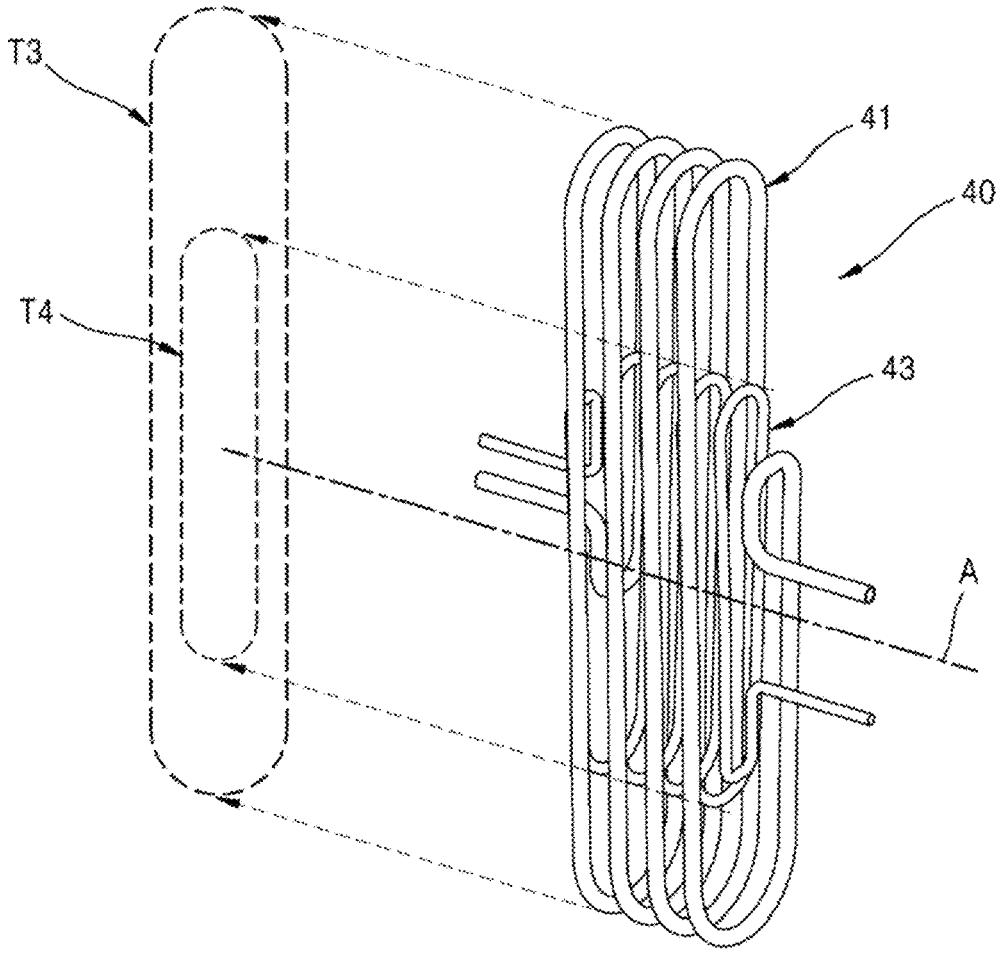
FIG. 9 is a perspective view of a coolant pipe according to an embodiment of the disclosure, when viewed from a virtual center axis direction.

FIG. 8A is a view showing a virtual projection trajectory of a coolant pipe according to an embodiment of the disclosure. FIG. 8B is a view showing a virtual projection trajectory of a coolant pipe according to an embodiment of the disclosure. FIG. 9 is a perspective view of a coolant pipe according to an embodiment of the disclosure, when viewed from a virtual center axis direction.

Referring to FIG. 8A, when the coolant pipe 40 of the window-type air-conditioner 10 according to an embodiment of the disclosure is viewed from the virtual center axis A direction, the outer circumferential surface of the coolant pipe 40 may form a virtual projection trajectory T1. The outer circumferential surface of the coolant pipe 40 may be a surface of the coolant pipe 40 located at the outermost position from the virtual center axis A, when the coolant pipe 40 is wound around the virtual center axis A to have a spiral shape.

According to an embodiment of the disclosure a virtual projection trajectory T1 may include two parallel line segments b1, a curved line b2 connecting one pair of end portions of the two line segments b1, and another curved line b2 connecting the other pair of end portions of the two line segments b1. The curved line b2 may be a part of the circumference of the virtual projection trajectory T1. However, the shape of the virtual projection trajectory T1 is not limited thereto. For example, the two line segments b1 may be not parallel to each other, but angled to each other. For example, the curved line b2 may be a part of a parabola.

However, the shape of the virtual projection trajectory T1 is not limited thereto, and may be various. For example, as illustrated in FIG. 8B, a virtual projection trajectory T2 according to an embodiment of the disclosure may be oval. The long side of an oval formed by the virtual projection trajectory T2 may be in a height direction of the window-type air-conditioner 10. The short side c of the oval formed by the virtual projection trajectory T2 may be less than the width of each of the outdoor module 20 and the indoor module 30. However, the shape and thickness of the virtual projection trajectory T2 are not limited thereto.

Referring to FIGS. 5B, 6B, and 9, the first coolant pipe 41 and the second coolant pipe 43 of the coolant pipe 40 according to an embodiment of the disclosure may each have the virtual projection trajectory T. The virtual projection trajectory T may be a shape formed as each of the first coolant pipe 41 and the second coolant pipe 43 repeats at a certain pitch with respect to the virtual center axis A. The shape formed by the repetition at a certain pitch may be a basic shape of the virtual projection trajectory T. The certain pitch may be a certain distance located on the interval I between the outdoor module 20 and the indoor module 30. The certain pitch may be a relative rotation angle progressed with respect to the virtual center axis A until the coolant pipe 40 forms the basic shape of the virtual projection trajectory T with respect to the virtual center axis A.

A virtual projection trajectory T3 formed by the first coolant pipe 41 according to an embodiment of the disclosure may be greater than a virtual projection trajectory T4 formed by the second coolant pipe 43. The shape formed as the first coolant pipe 41 repeats at a certain pitch with respect to the virtual center axis A may be greater than the shape formed as the second coolant pipe 43 repeats at a certain pitch with respect to the virtual center axis A. The certain pitch may be different in the second coolant pipe 43 and the first coolant pipe 41. However, the virtual projection trajectory T of the first coolant pipe 41 and the second coolant pipe 43 is not limited to the above description. For example, the virtual projection trajectory T4 formed by the second coolant pipe 43 may be greater than the virtual projection trajectory T3 formed by the first coolant pipe 41.

The virtual projection trajectory T4 of the second coolant pipe 43 according to an embodiment of the disclosure may be formed inside the virtual projection trajectory T3 of the first coolant pipe 41. The virtual projection trajectory T4 of the second coolant pipe 43 may be formed inside the shape formed as the first coolant pipe 41 repeats at a certain pitch with respect to the virtual center axis A. However, the virtual projection trajectory T of the first coolant pipe 41 and the second coolant pipe 43 are not limited to the above description.

The virtual projection trajectory T may have various basic shapes in addition to the shape described above, under conditions formed with respect to the virtual center axis A. For example, the virtual projection trajectory T may be circular. For example, the virtual projection trajectory T may be polygonal such as triangular or more. A polygon may include a combination of straight lines and curved lines. For example, the vertex of a polygon may have a curved shape.

The virtual projection trajectory T may be formed with respect to the virtual center axis A, but may not have a cyclic shape. For example, the virtual projection trajectory T formed by the coolant pipe 40 may form a certain shape with respect to the virtual center axis A, but the certain shape may be repeated in a non-cyclic manner.

The virtual center axis A and the virtual projection trajectory T described above may be an example to describe the function of the coolant pipe 40. In addition to the above description, among the available shapes and structures of the coolant pipe 40, any shape and structure of the coolant pipe 40 capable of performing a function to provide a flow path for stably moving the coolant between the outdoor module 20 and the indoor module 30 even when the interval between the outdoor module 20 and the indoor module 30 is adjusted may belong to the embodiment of the disclosure.

Figure 10:
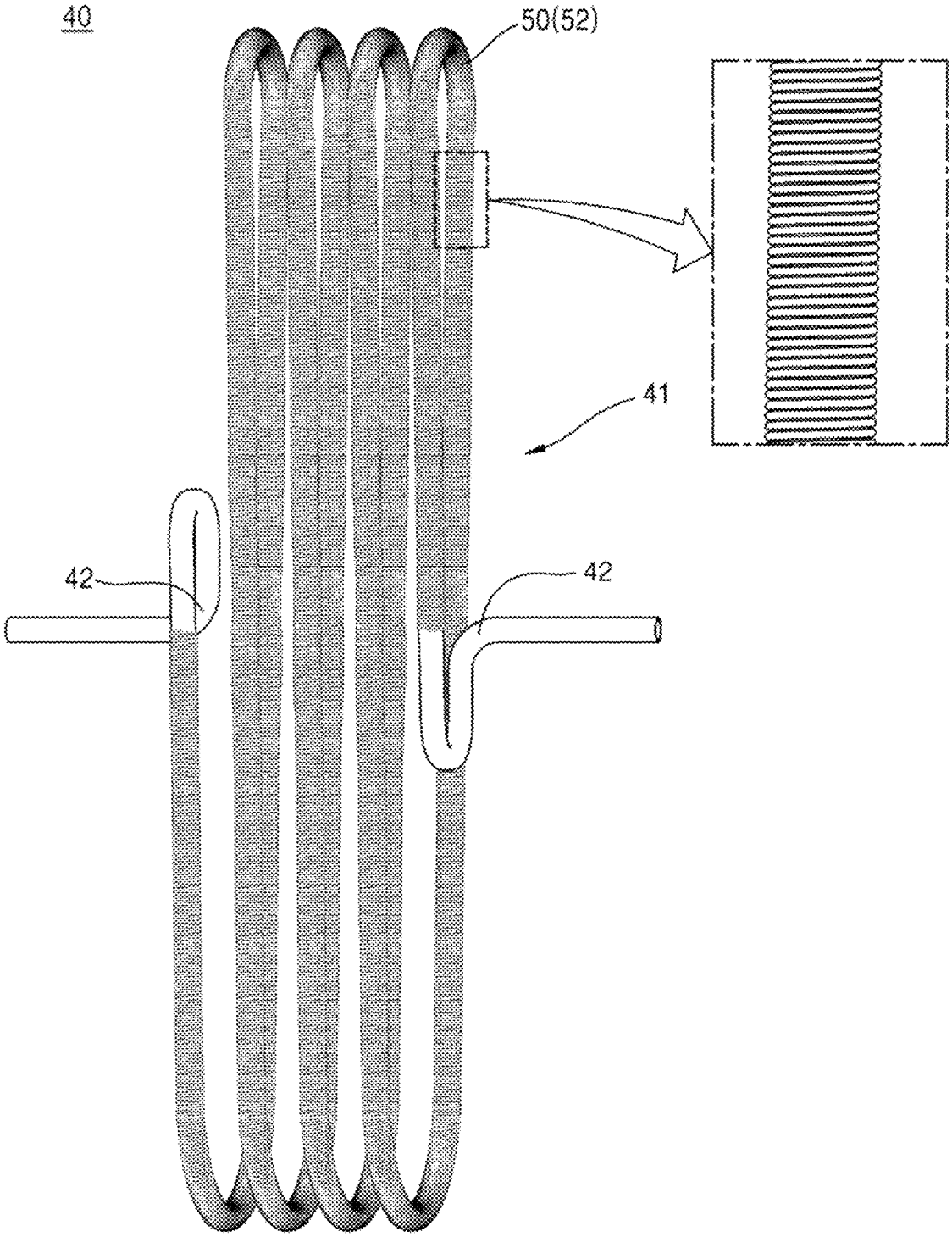
FIG. 10 is a view for describing a coil spring according to an embodiment of the disclosure.

FIG. 10 is a view for describing a coil spring according to an embodiment of the disclosure.

Referring to FIG. 10, the pipe support member 50 of the coolant pipe 40 according to an embodiment of the disclosure may include a coil spring 52. The coil spring 52 may surround the coolant pipe 40. The coil spring 52 may be configured to prevent the coolant pipe 40 from being broken when the interval I between the indoor module 30 and the outdoor module 20 is adjusted. The coil spring 52 may apply a tension of a certain strength to the coolant pipe 40. The coil spring 52 may function to disperse a force to prevent stress focused on a particular portion of the coolant pipe 40 when the interval I between the indoor module 30 and the outdoor module 20 is adjusted. Although FIG. 10 illustrates that the coil spring 52 surrounds the first coolant pipe 41, this is an example, and the coil spring 52 may surround the second coolant pipe 43.

Figure 11A:
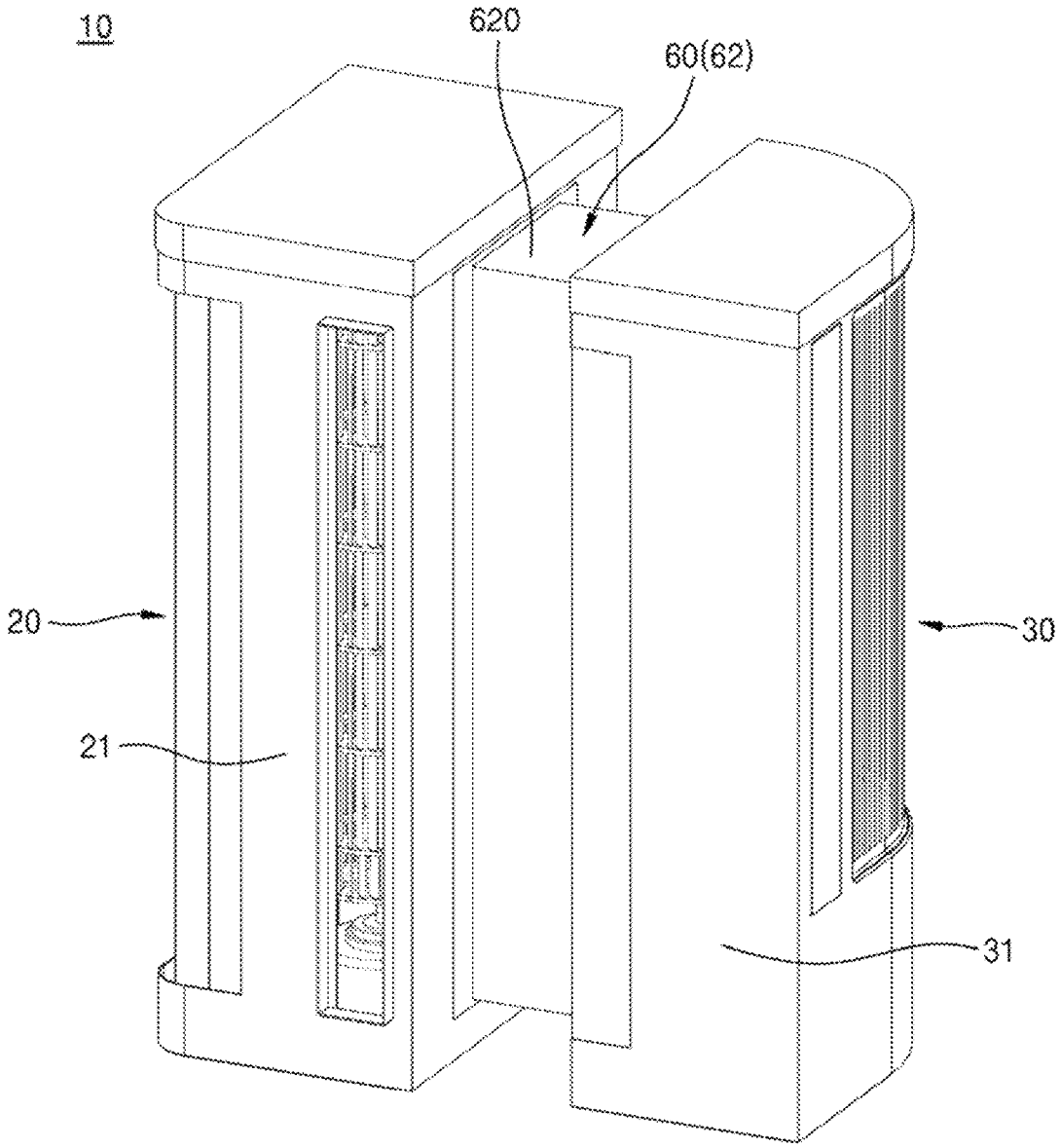
FIGS. 11A and 11B are views for describing a pipe cover having a multi-step shape, according to an embodiment of the disclosure.
Figure 11B:
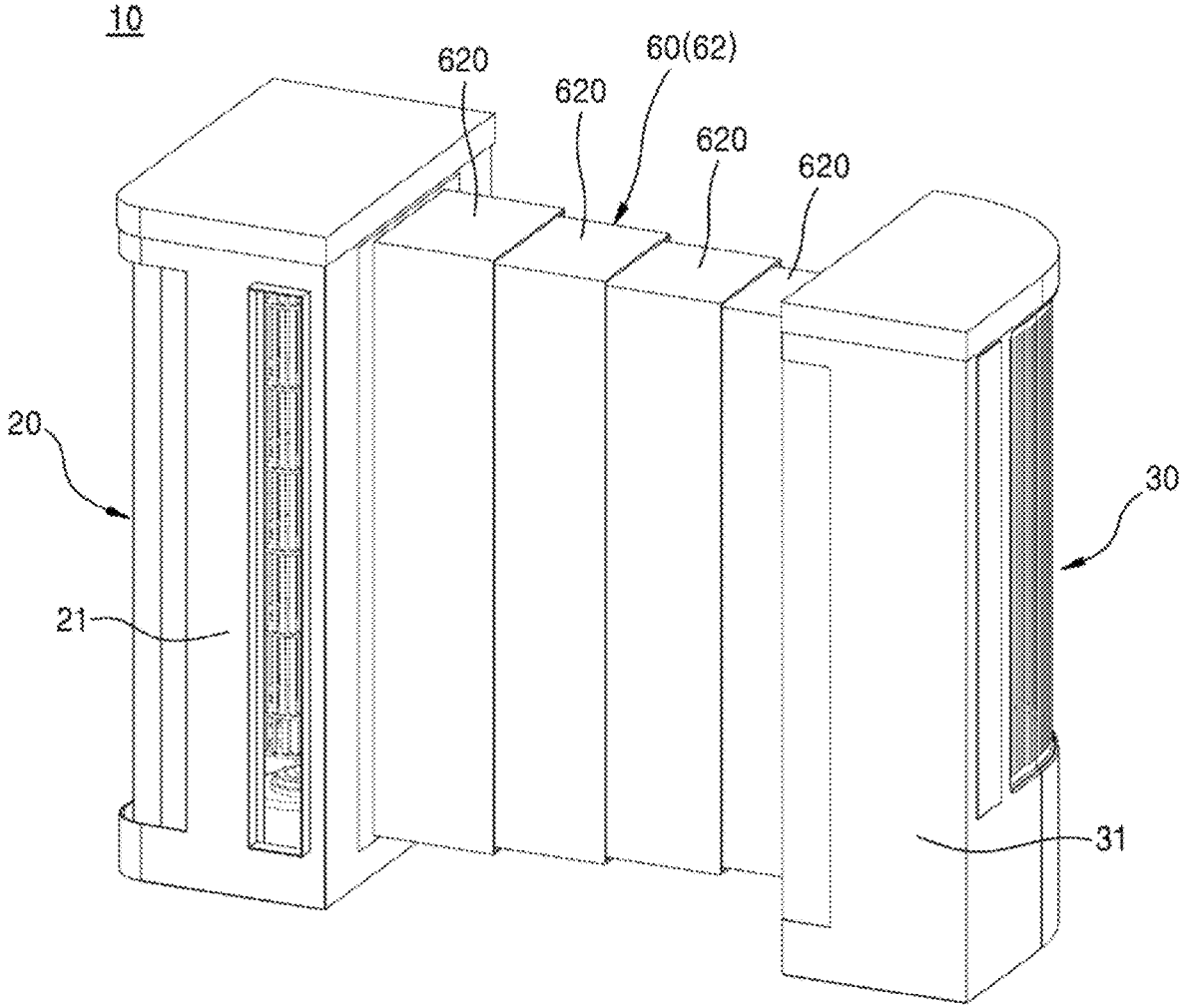

FIG. 11A is a view for describing a pipe cover having a multi-step shape according to an embodiment of the disclosure. FIG. 11B is a view for describing a pipe cover having a multi-step shape according to an embodiment of the disclosure.

Referring to FIGS. 11A and 11B, the pipe cover 60 according to an embodiment of the disclosure may have a multi-step shape 62. The pipe cover 60 having the multi-step shape 62 may include a plurality of steps 620. The pipe cover 60 having the multi-step shape 62 may include the steps 620 having different sizes and overlapping each other. The pipe cover 60 having the multi-step shape 62 may be configured such that the steps 620 overlapping each other protrude outside or retract inside depending on the adjustment of the interval I between the outdoor module 20 and the indoor module 30.

Figure 12A:
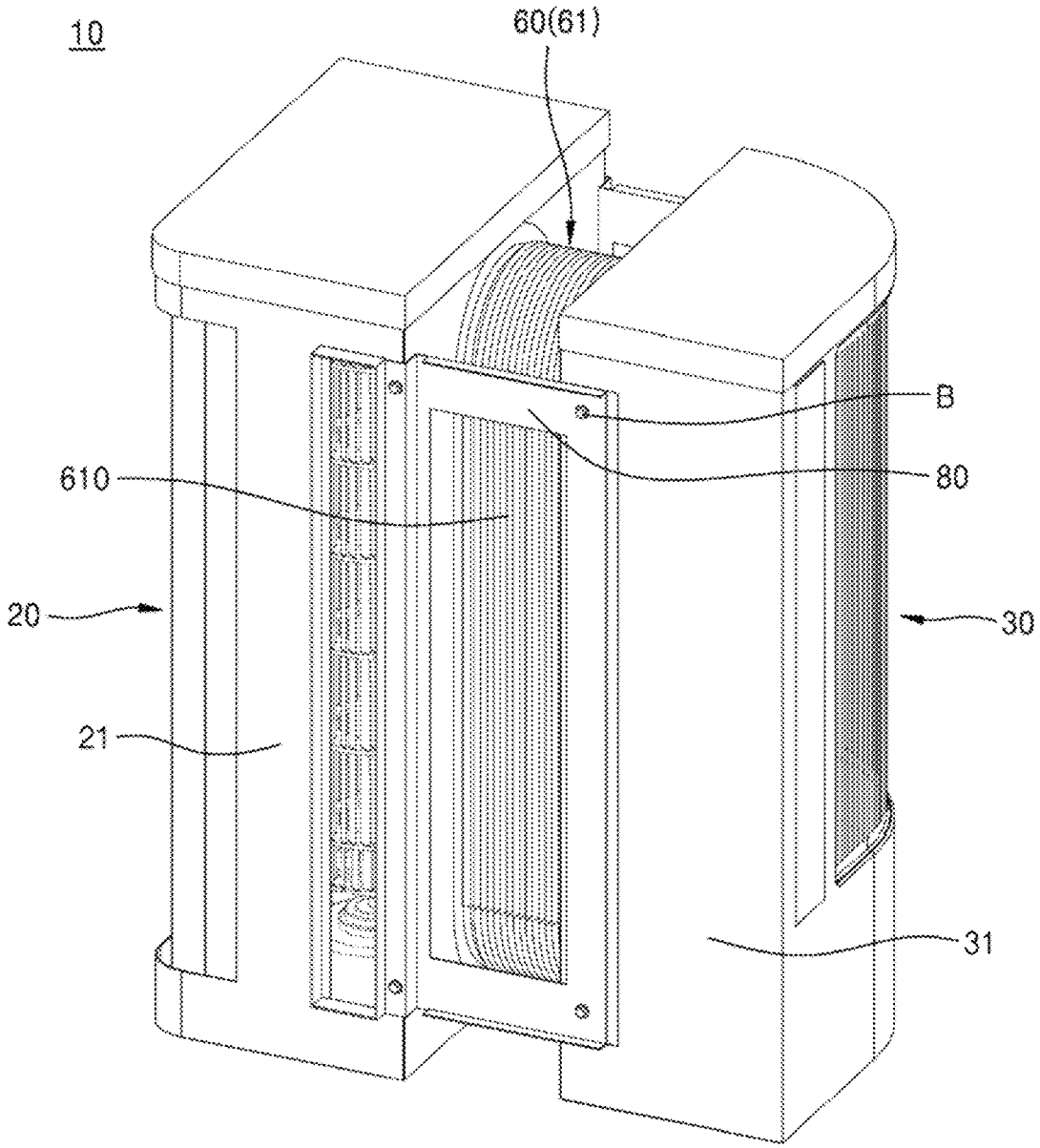
FIGS. 12A and 12B are views for describing a temporary support portion according to an embodiment of the disclosure.
Figure 12B:
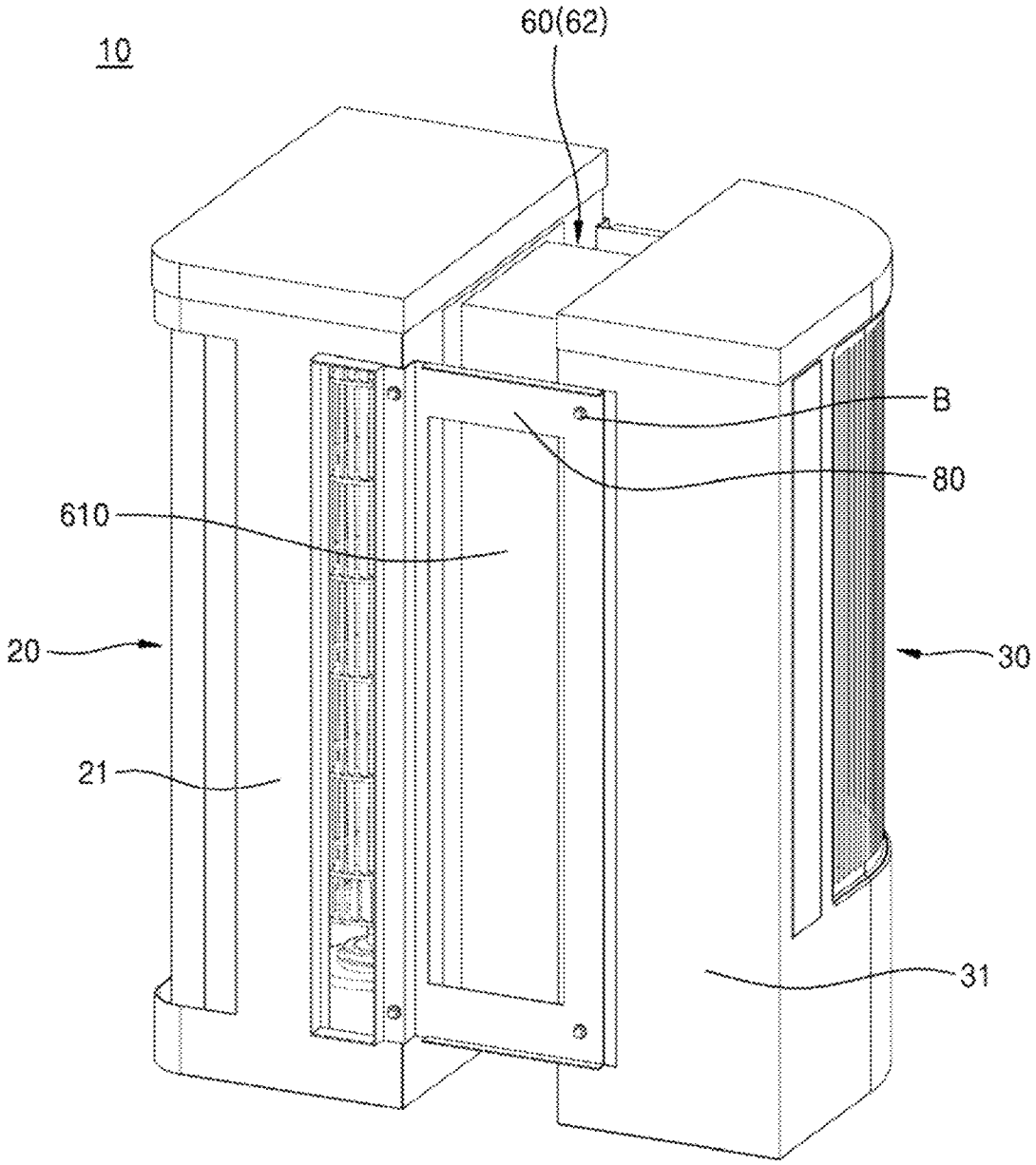

FIG. 12A is a view for describing a temporary support portion according to an embodiment of the disclosure. FIG. 12B is a view for describing a temporary support portion according to an embodiment of the disclosure.

Referring to FIGS. 1, 12A, and 12B, the window-type air-conditioner 10 according to an embodiment of the disclosure may include a temporary support portion 80. The temporary support portion 80 may support the indoor module 30 and the outdoor module 20 and may be removed before the window-type air-conditioner 10 is installed on the window frame 1. The temporary support portion 80 may be removed before adjusting the positions of the outdoor module 20 and the indoor module 30 of the window-type air-conditioner 10.

The temporary support portion 80 may fix the relative positions of the outdoor module 20 and the indoor module 30 to facilitate carrying the window-type air-conditioner 10. The temporary support portion 80 may include a plurality of temporary support portions. The temporary support portion 80 may be arranged in the front and rear surfaces of the window-type air-conditioner 10.

Figure 13:
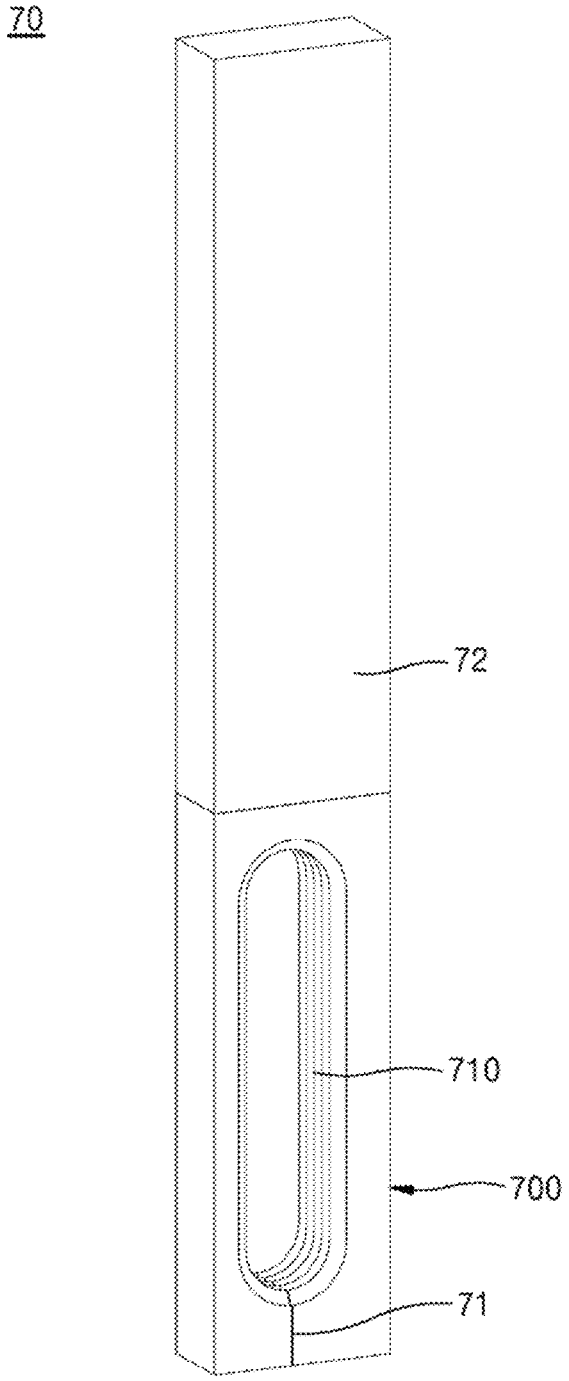
FIG. 13 is a view for describing a sealing member according to an embodiment of the disclosure.

FIG. 13 is a view for describing a sealing member according to an embodiment of the disclosure.

Referring to FIGS. 1 and 13, the window-type air-conditioner 10 according to an embodiment of the disclosure may include a sealing member 70. The sealing member 70 may seal a gap between the outer circumferential surface of the pipe cover 60 and the window frame 1 on a plane perpendicular to a direction in which the pipe cover 60 extends. The sealing member 70 may be connected to the pipe cover 60. The sealing member 70 may seal a gap between the window frame 1 and the window 11.

The sealing member 70 may include an insertion portion 700. The insertion portion 700 may be a portion for inserting the pipe cover 60. The insertion portion 700 may include a cut portion 71. The cut portion 71 may be a portion that is cut in a lower end portion of the insertion portion 700. The pipe cover 60 may be inserted into the insertion portion 700 through the cut portion 71.

The sealing member 70 may include an upper insulating member 72. The upper insulating member 72 may be located above the insertion portion 700. However, the positional relationship between the upper insulating member 72 and the insertion portion 700 is not limited thereto.

The insertion portion 700 may have a shape corresponding to the shape of the pipe cover 60. The insertion portion 700 may include an uneven portion 710. The uneven portion 710 of the insertion portion 700 may be a portion corresponding to the corrugations 610 of the pipe cover 60 having the bellows structure 61, on a coupling surface in contact with the outer circumferential surface of the pipe cover 60. The uneven portion 710 of the insertion portion 700 may assist a close contact between the sealing member 70 and the pipe cover 60, when the bellows structure 61 is inserted into the insertion portion 700. The uneven portion 710 of the insertion portion 700 may improve the insulation performance of the sealing member 70.

Figure 14:
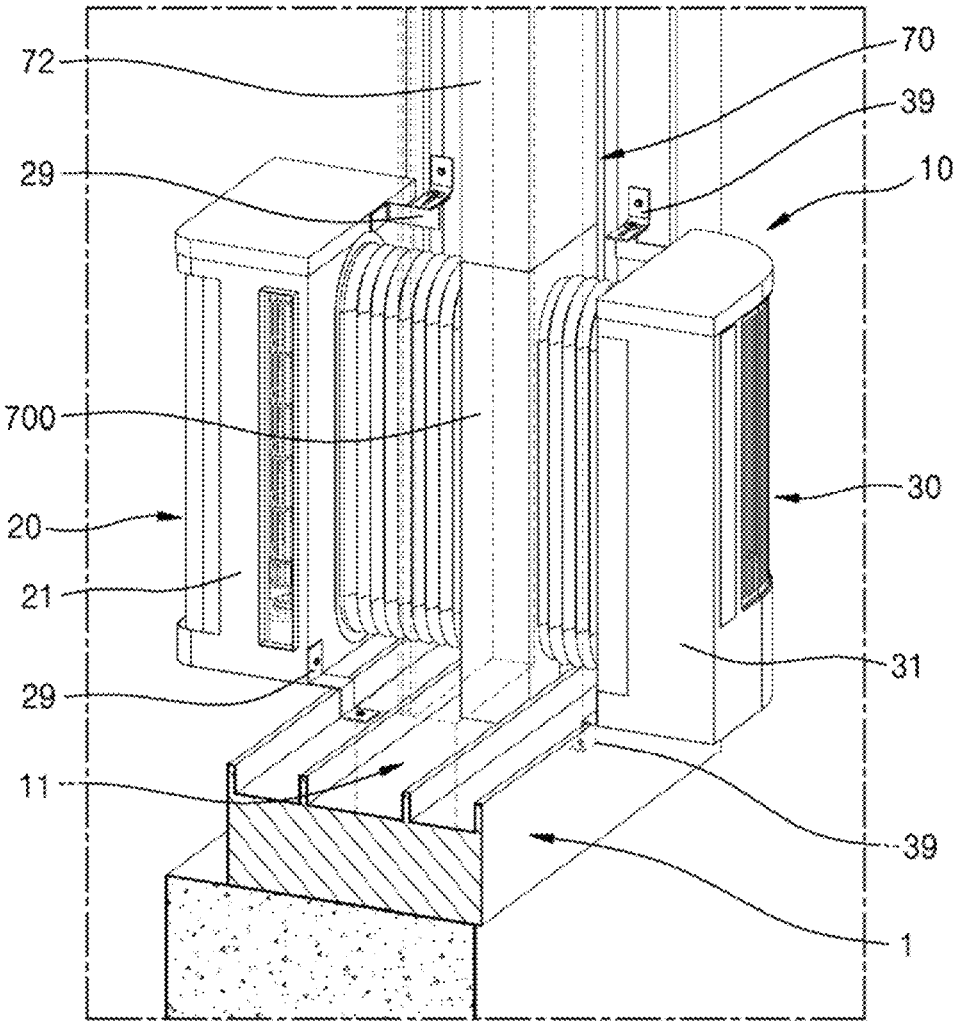
FIG. 14 is a view showing a window-type air-conditioner according to an embodiment of the disclosure when installed.
Figure 15:
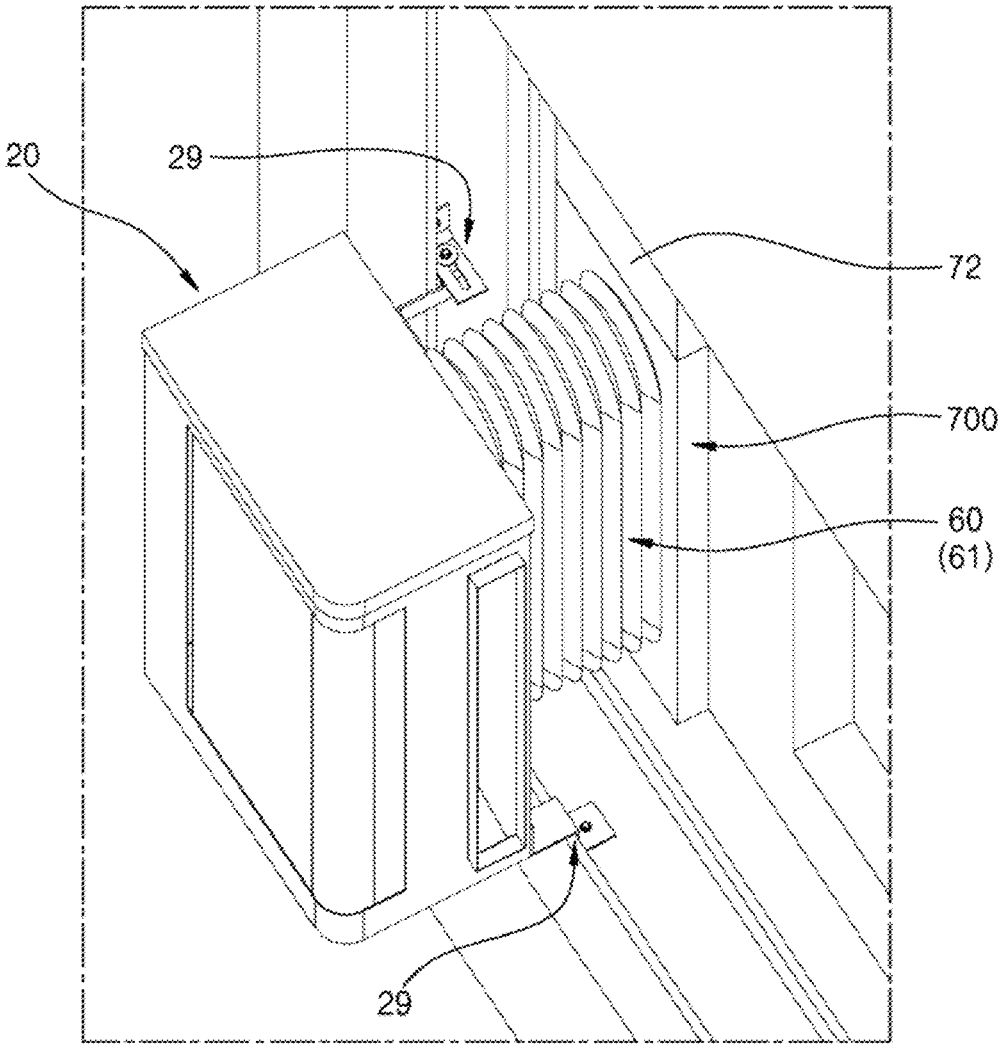
FIG. 15 is a view showing a window-type air-conditioner according to an embodiment of the disclosure when installed.

FIG. 14 is a view showing that a window-type air-conditioner according to an embodiment of the disclosure is installed. FIG. 15 is a view showing that a window-type air-conditioner according to an embodiment of the disclosure is installed.

Referring to FIGS. 1, 14, and 15, the window-type air-conditioner 10 according to an embodiment of the disclosure may be fixed to the window frame 1 by a coupling member 29. The outdoor module 20 may be fixed to the window frame 1 by the coupling member 29. The indoor module 30 may be fixed to the window frame 1 by a coupling member 39.

Figure 16:
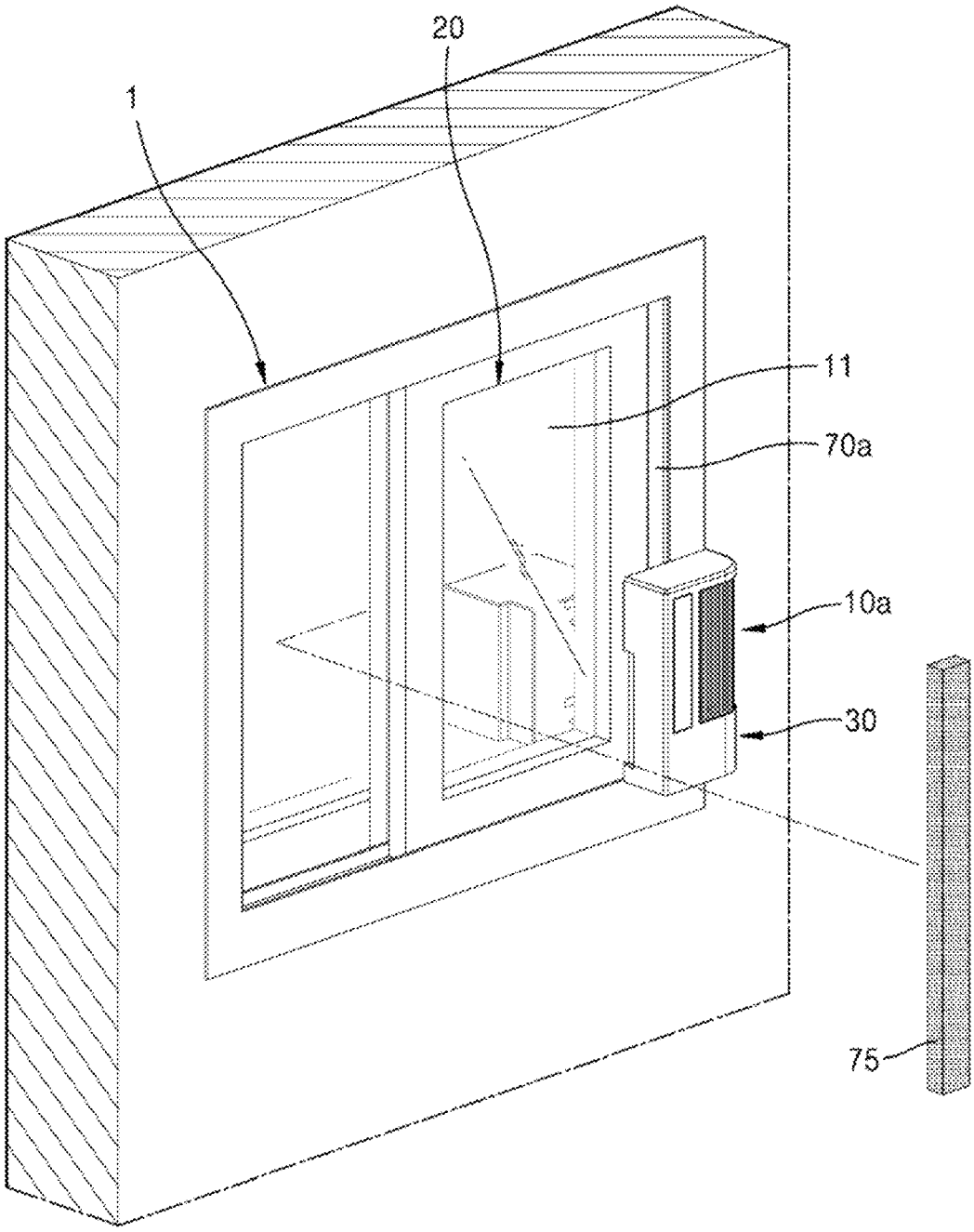
FIG. 16 is a view illustrating a window-type air-conditioner according to an embodiment of the disclosure installed on a window frame.
Figure 17:
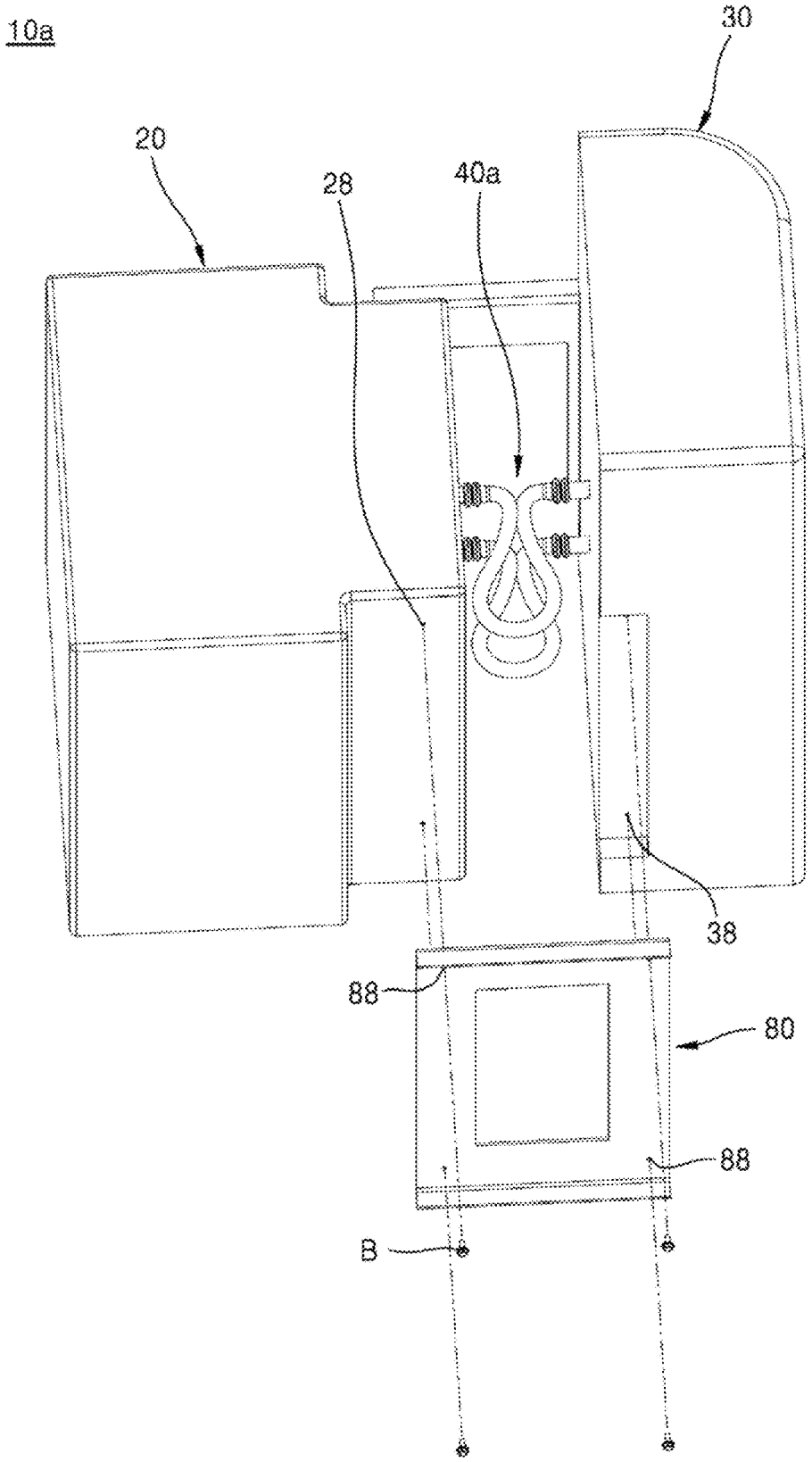
FIG. 17 is a view showing a window-type air-conditioner according to an embodiment of the disclosure being connected to a temporary support portion.
Figure 18:
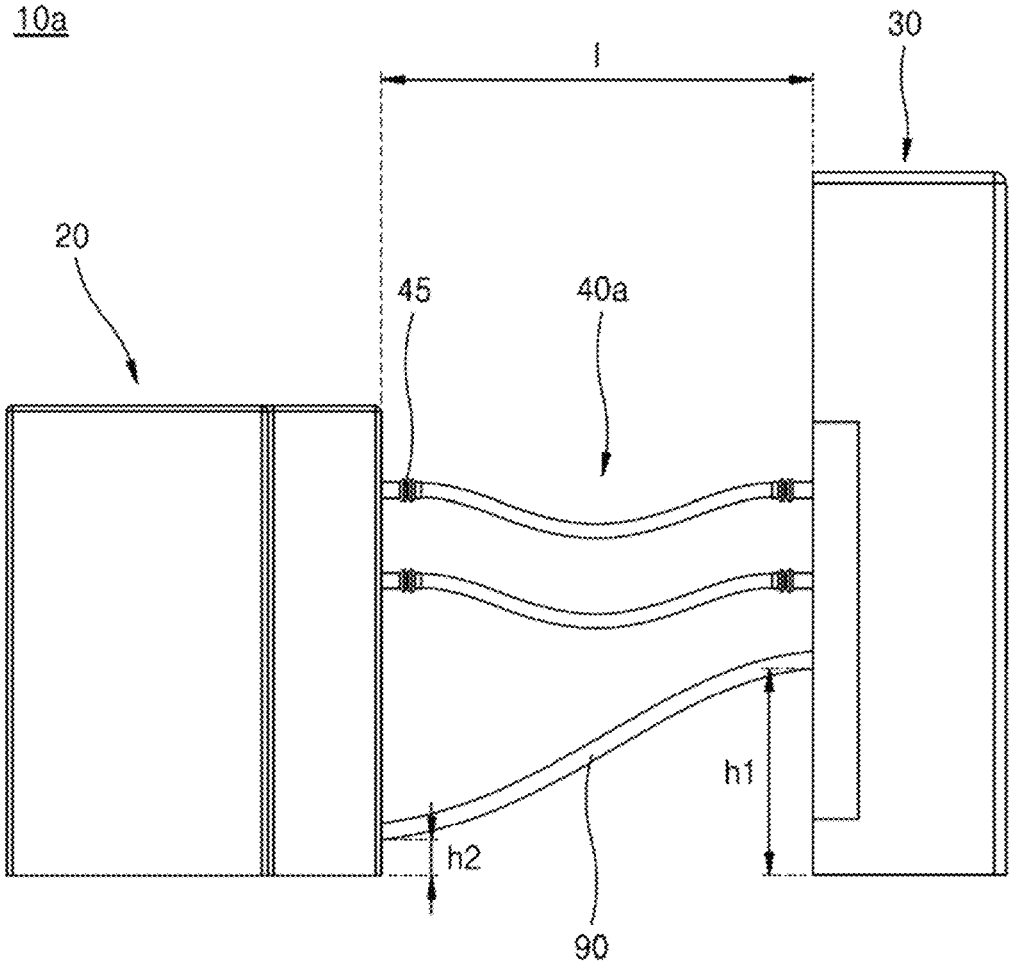
FIG. 18 is a front view of a window-type air-conditioner according to an embodiment of the disclosure.

FIG. 16 is a view illustrating that a window-type air-conditioner according to an embodiment of the disclosure is installed on a window frame. FIG. 17 is a view showing that a window-type air-conditioner according to an embodiment of the disclosure is connected to the temporary support portion. FIG. 18 is a front view of a window-type air-conditioner according to an embodiment of the disclosure.

Referring to FIGS. 16 to 18, a window-type air-conditioner 10*a* according to an embodiment of the disclosure may include the outdoor module 20, the indoor module 30, and a flexible coolant pipe 40*a*. As the outdoor module 20 and the indoor module 30 are the same as those of the embodiments described above, redundant descriptions thereof are omitted and only differenced are described. The flexible coolant pipe 40*a* according to an embodiment of the disclosure may provide a flow path through which the coolant moves between the outdoor module 20 and the indoor module 30.

Both end portions of the flexible coolant pipe 40*a* may be connected to the outdoor module 20 and the indoor module 30. The flexible coolant pipe 40*a* may be configured to have a deformed shape as the interval between the outdoor module 20 and the indoor module 30 is adjusted. The middle portion of the flexible coolant pipe 40*a* may sag due to gravity. A portion of the flexible coolant pipe 40*a* at the highest vertical position may be the end portion of the flexible coolant pipe 40*a*. The end portion of the flexible coolant pipe 40*a* may be the end portion connected to the outdoor module 20 or the end portion connected to the indoor module 30. However, the shape of the flexible coolant pipe 40*a* is not limited to the above description.

Figure 19:
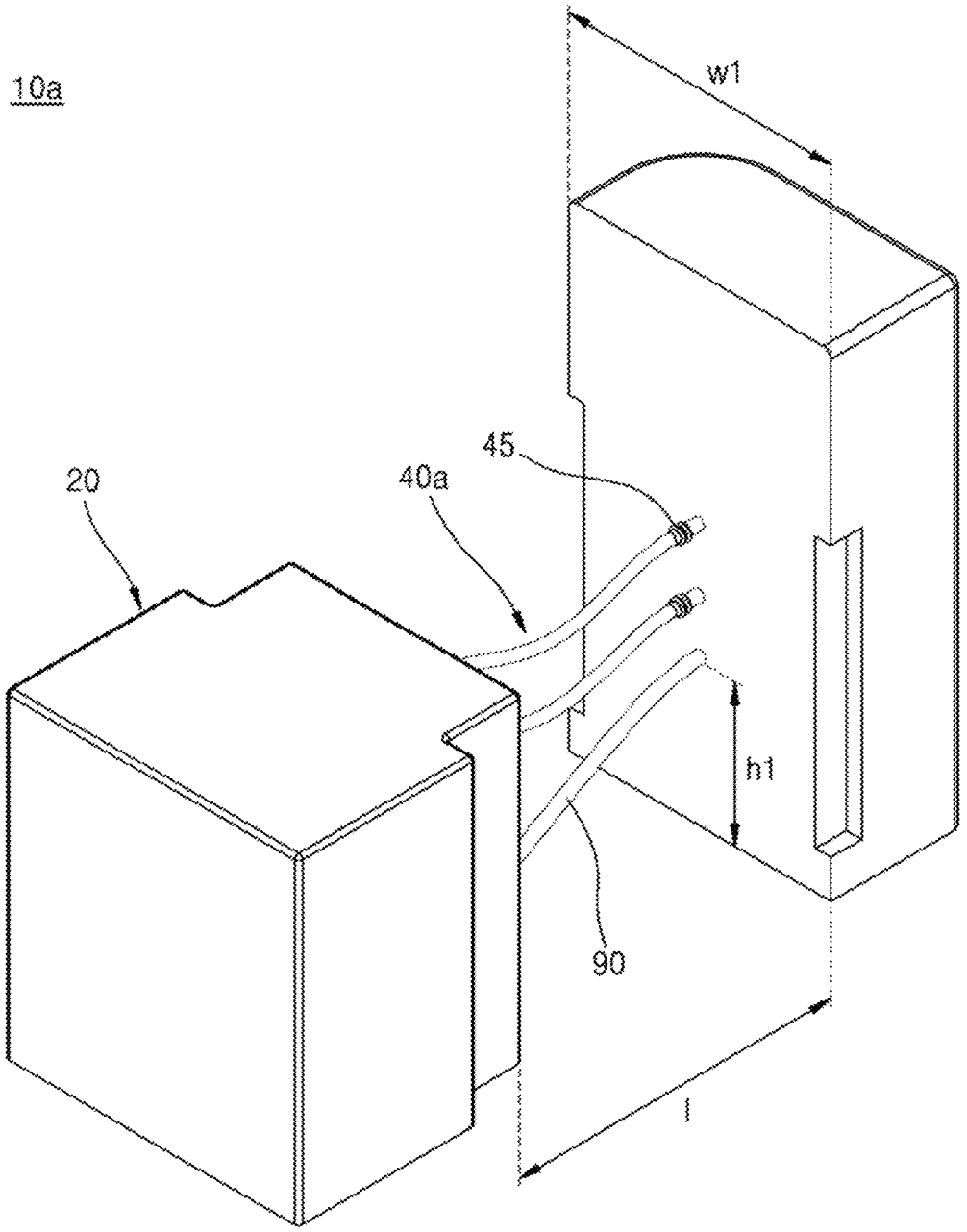
FIG. 19 is a perspective view of a window-type air-conditioner according to an embodiment of the disclosure.
Figure 20:
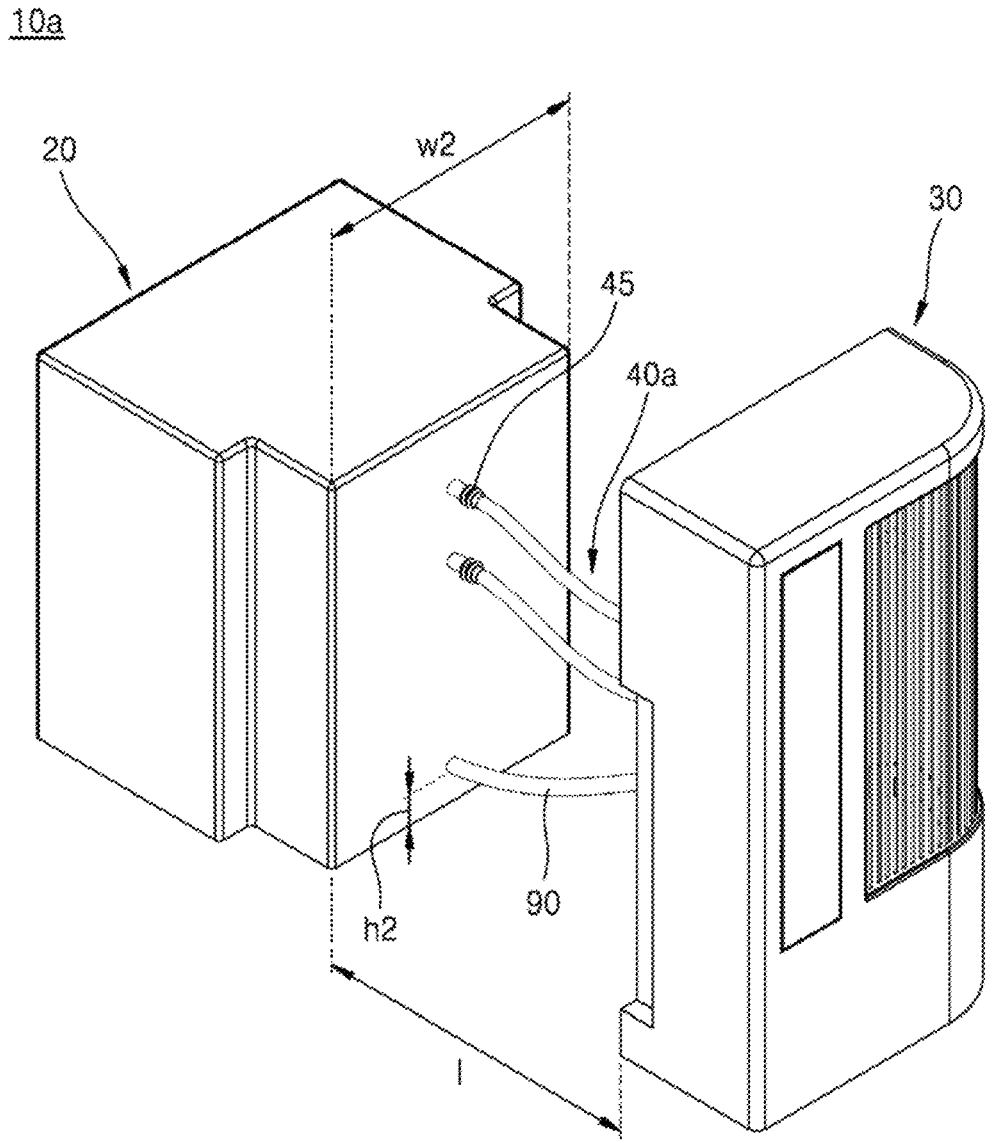
FIG. 20 is a perspective view of a window-type air-conditioner according to an embodiment of the disclosure.
Figure 21:
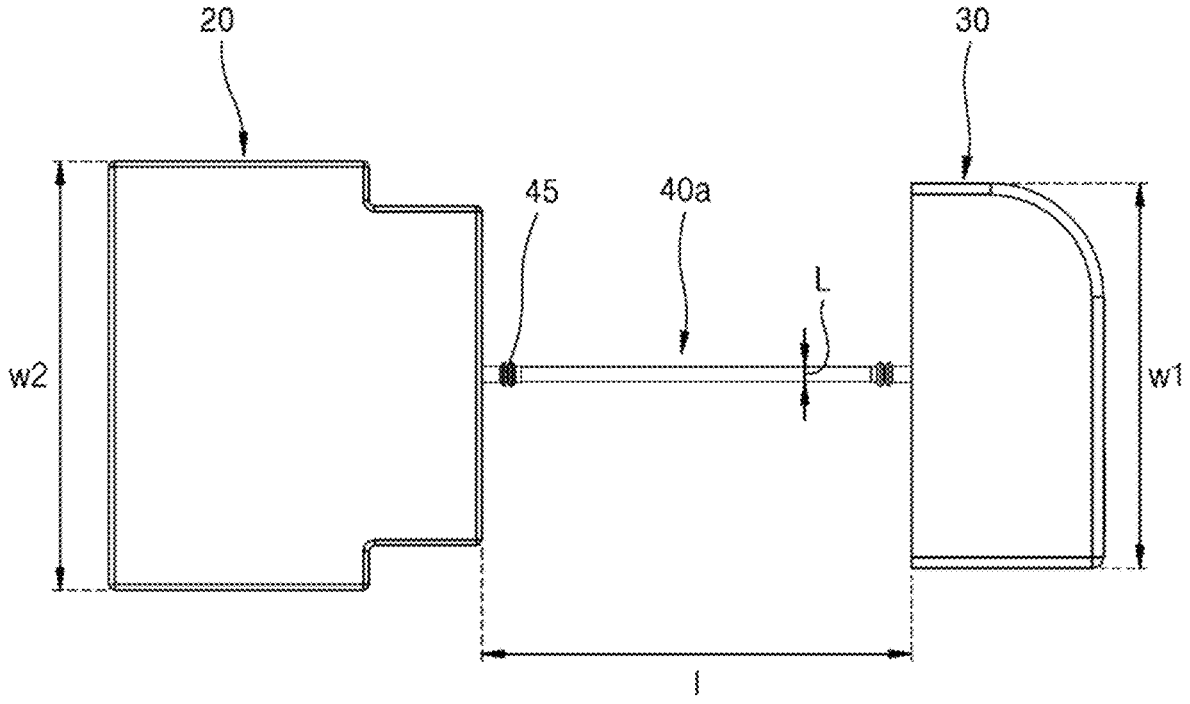
FIG. 21 is a plan view of a window-type air-conditioner according to an embodiment of the disclosure.

FIG. 19 is a perspective view of a window-type air-conditioner according to an embodiment of the disclosure. FIG. 20 is a perspective view of a window-type air-conditioner according to an embodiment of the disclosure. FIG. 21 is a plan view of a window-type air-conditioner according to an embodiment of the disclosure.

Referring to FIGS. 19 to 21, the flexible coolant pipe 40*a* of a window-type air-conditioner 10*a* according to an embodiment of the disclosure may be connected to the indoor module 30 through a connection nozzle 45 in the middle portion in a width direction w1 of the indoor module 30. The flexible coolant pipe 40*a* of the window-type air-conditioner 10*a* may be connected to the outdoor module 20 through the connection nozzle 45 in the middle portion in a width direction w2 of the outdoor module 20.

The window-type air-conditioner 10*a* may be installed on not only the right (see FIG. 16), but also the left of the window frame 1. When the flexible coolant pipe 40*a* of the window-type air-conditioner 10*a* is connected to the indoor module 30 and the outdoor module 20 through the connection nozzle 45 at a position deviated to one side with respect to the width direction w1 of the indoor module 30 and the width direction w2 of the outdoor module 20, and the window-type air-conditioner 10*a* is installed on the left and on the right, the window 11 (see FIG. 16) may not be uniformly closed. When the flexible coolant pipe 40*a* of the window-type air-conditioner 10*a* is connected to the indoor module 30 and the outdoor module 20 through the connection nozzle 45 in the middle portion of the width direction w1 of the indoor module 30 and the width direction w2 of the outdoor module 20, the window-type air-conditioner 10*a* may be selectively installed on the left or right of the window frame 1.

Referring to FIGS. 20 and 21, the flexible coolant pipe 40*a* according to an embodiment of the disclosure ma have a linear shape when viewed from the top of the window-type air-conditioner 10*a*. A thickness L of the flexible coolant pipe 40*a* when viewed from the top of the window-type air-conditioner 10*a* may be 1% or more and 20% or less of the width w1 of the indoor module 30. The thickness L of the flexible coolant pipe 40*a* when viewed from the top of the window-type air-conditioner 10*a* may be 1% or more and 20% or less of the width w1 of the outdoor module 20.

Figure 22:
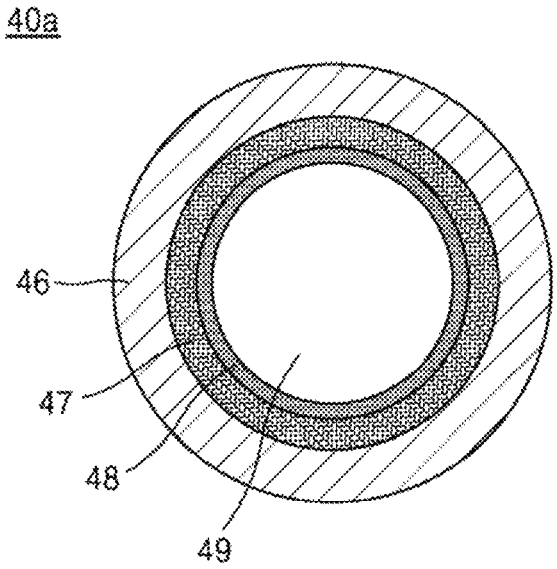
FIG. 22 is a cross-sectional view of a flexible coolant pipe according to an embodiment of the disclosure.

FIG. 22 is a cross-sectional view of a flexible coolant pipe according to an embodiment of the disclosure.

Referring to FIGS. 18 to 22, the flexible coolant pipe 40*a* according to an embodiment of the disclosure may provide a flow path through which the coolant moves even in a bent or curved state. The flexible coolant pipe 40*a* may allow adjustment of the interval between the outdoor module 20 and the indoor module 30. The flexible coolant pipe 40*a* may include a rubber material.

The flexible coolant pipe 40*a* may have a multi-layer structure for pressure-resistant design and coolant leakage prevention. For example, the flexible coolant pipe 40*a* may include a plurality of layers having different materials. The flexible coolant pipe 40*a* may include an outer layer 46 of a rubber material. The flexible coolant pipe 40*a* may include a netting wire layer 47. The flexible coolant pipe 40*a* may include a bellows layer (not shown) of a metal material. The flexible coolant pipe 40*a* may include a resin film layer 48. The resin film layer 48 may prevent the leakage of coolant between the netting wire layer 47 and a coolant flow path 49. The plurality of layers included in the flexible coolant pipe 40*a* may selectively include the outer layer 46, the bellows layer, the resin film layer 48, and the netting wire layer 47. However, the multi-layer structure of the flexible coolant pipe 40*a* is not limited thereto.

The outdoor module 20 and the indoor module 30 may each include the connection nozzle 45 that is connectable to the flexible coolant pipe 40*a*. Both end portions of the flexible coolant pipe 40*a* may be in contact with the outdoor module 20 and the indoor module 30 through the connection nozzle 45. Both end portions of the flexible coolant pipe 40*a* may be connected to the outdoor module 20 and the indoor module 30 through the connection nozzle 45. The flexible coolant pipe 40*a* may be configured to transmit the coolant to the outdoor module 20 and the indoor module 30 or receive the coolant from the outdoor module 20 and the indoor module 30, through the connection nozzle 45.

Both end portions of the flexible coolant pipe 40*a* may be connected to the connection nozzle 45 through a swaging process. In other words, when both end portions of the flexible coolant pipe 40*a* are inserted into the connection nozzle 45, by applying a compressive force from the outer circumference to the inner circumference of the end portion of the flexible coolant pipe 40*a*, the flexible coolant pipe 40*a* may be connected to the connection nozzle 45. Both end portions of the flexible coolant pipe 40*a* may be connected to the connection nozzle 45 through welding. However, the method of connecting the flexible coolant pipe 40*a* to the connection nozzle 45 is not limited thereto.

The window-type air-conditioner 10*a* according to an embodiment of the disclosure may include a drain pipe 90. The drain pipe 90 may function to transfer the condensate generated from the indoor module 30 to the outdoor module 20. A height h1 at which the drain pipe 90 is connected to the indoor module 30 may be greater than a height h2 at which the drain pipe 90 is connected to the outdoor module 20. When the height h1 at which the drain pipe 90 is connected to the indoor module 30 is greater than the height h2 at which the drain pipe 90 is connected to the outdoor module 20, the condensate may be easily moved in a direction from the indoor module 30 to the outdoor module 20.

As described above, when the window-type air-conditioner 10*a* in which the flexible coolant pipe 40*a* is arranged between the outdoor module 20 and the indoor module 30 is installed on the window frame 1, the interval between the outdoor module 20 and the indoor module 30 may be easily adjusted. However, the window-type air-conditioner 10*a* may be difficult to transport before the window-type air-conditioner 10*a* is installed on the window frame 1. For example, in the carrying process of the window-type air-conditioner 10*a*, when the interval between the outdoor module 20 and the indoor module 30 becomes greater than the length of the flexible coolant pipe 40*a*, the flexible coolant pipe 40*a* may be broken. In order to prevent the breakage of the flexible coolant pipe 40*a*, the window-type air-conditioner 10*a* according to an embodiment of the disclosure may include the temporary support portion 80 supporting the indoor module 30 and the outdoor module 20 and removed before the flexible coolant pipe 40*a* is installed on the window frame 1.

Referring back to FIG. 17, the temporary support portion 80 according to an embodiment of the disclosure may include a second coupling portion 88 to fix the outdoor module 20 and the indoor module 30. The outdoor module 20 may include a first coupling portion 28 to be fixed to the temporary support portion 80. The indoor module 30 may include a first coupling portion 38 to be fixed to the temporary support portion 80. The first coupling portion 28 of the outdoor module 20 and the first coupling portion 38 of the indoor module 30 may have a similar shape. The second coupling portion 88 of the temporary support portion 80 may correspond to each of the first coupling portion 28 of the outdoor module 20 and the first coupling portion 38 of the indoor module 30. The first coupling portion 28 of the outdoor module 20, the first coupling portion 38 of the indoor module 30, and the second coupling portion 88 of the temporary support portion 80 may each have a hole shape. The first coupling portion 28 of the outdoor module 20, the first coupling portion 38 of the indoor module 30, and the second coupling portion 88 of the temporary support portion 80 may each include a plurality of coupling portions. However, the shapes and numbers of the first coupling portion 28 of the outdoor module 20, the first coupling portion 38 of the indoor module 30, and the second coupling portion 88 of the temporary support portion 80 are not limited to the above description.

According to an embodiment of the disclosure, the first coupling portion 28 of the outdoor module 20 and the first coupling portion 38 of the indoor module 30 may be interlocked with the second coupling portion 88 of the temporary support portion 80. In other words, the first coupling portion 28 of the outdoor module 20 and the first coupling portion 38 of the indoor module 30 may each be located at a position to be overlapped with the second coupling portion 88 of the temporary support portion 80. For example, the first coupling portion 28 of the outdoor module 20 and the first coupling portion 38 of the indoor module 30 may be arranged in the form of concentric circles with the second coupling portion 88 of the temporary support portion 80. A fixing member B may be used to fix the first coupling portion 28 of the outdoor module 20, the first coupling portion 38 of the indoor module 30, and the second coupling portion 88 of the temporary support portion 80. Although the fixing member B may be a bolt, the disclosure is not limited thereto. However, the method of fixing the first coupling portion 28 of the outdoor module 20, the first coupling portion 38 of the indoor module 30, and the second coupling portion 88 of the temporary support portion 80 is not limited to the above description, and any fixing method to be easily applicable by a person skilled in the art is possible. For example, the first coupling portion 28 of the outdoor module 20, the first coupling portion 38 of the indoor module 30, and the second coupling portion 88 of the temporary support portion 80 may perform a fixing function by a hook method. For example, the first coupling portion 28 of the outdoor module 20, the first coupling portion 38 of the indoor module 30, and the second coupling portion 88 of the temporary support portion 80 may perform a fixing function by a clasp method. For example, the first coupling portion 28 of the outdoor module 20, the first coupling portion 38 of the indoor module 30, and the second coupling portion 88 of the temporary support portion 80 may perform a fixing function by a lever method.

In FIG. 17, although the temporary support portion 80 is illustrated as an empty rectangular shape, the shape of the temporary support portion 80 is not limited thereto. For example, the temporary support portion 80 may has a trapezoidal shape.

In FIG. 17, although the temporary support portion 80 supports the outdoor module 20 and the indoor module 30 on the side surfaces of the outdoor module 20 and the indoor module 30, the arrangement of the temporary support portion 80 is not limited thereto. For example, the temporary support portion 80 may support the outdoor module 20 and the indoor module 30 from the top or bottom of the outdoor module 20 and the indoor module 30.

The temporary support portion 80 may be configured to have a certain strength. For example, the material of the temporary support portion 80 may include steel. For example, the temporary support portion 80 may include zinc plated steel. However, the material of the temporary support portion 80 is not limited thereto, and any material and structure having a certain strength is possible.

The temporary support portion 80 may be removed before the window-type air-conditioner 10*a* is installed on the window frame 1. For example, while the window-type air-conditioner 10*a* is placed on the window frame 1, the temporary support portion 80 may be removed.

Figure 23:
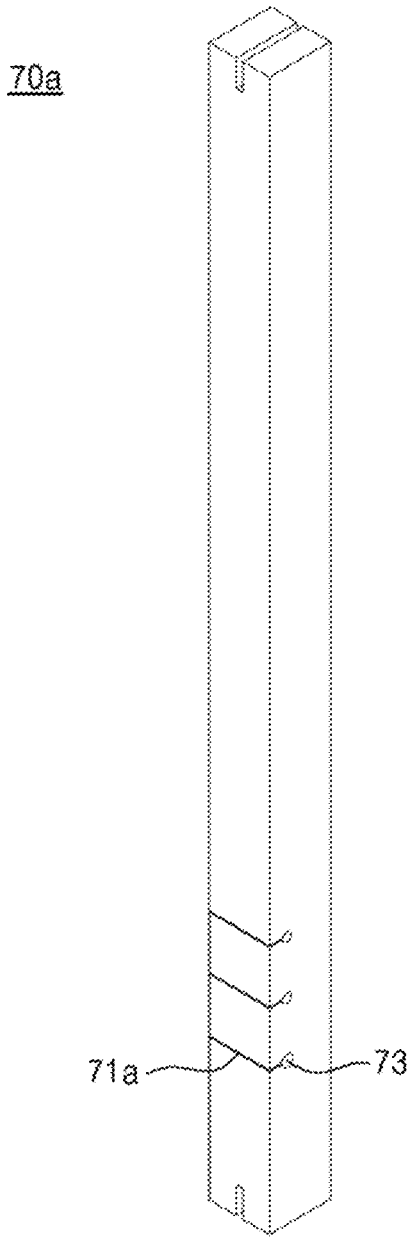
FIG. 23 is a perspective view of a sealing member of a window-type air-conditioner according to an embodiment of the disclosure.
Figure 24:
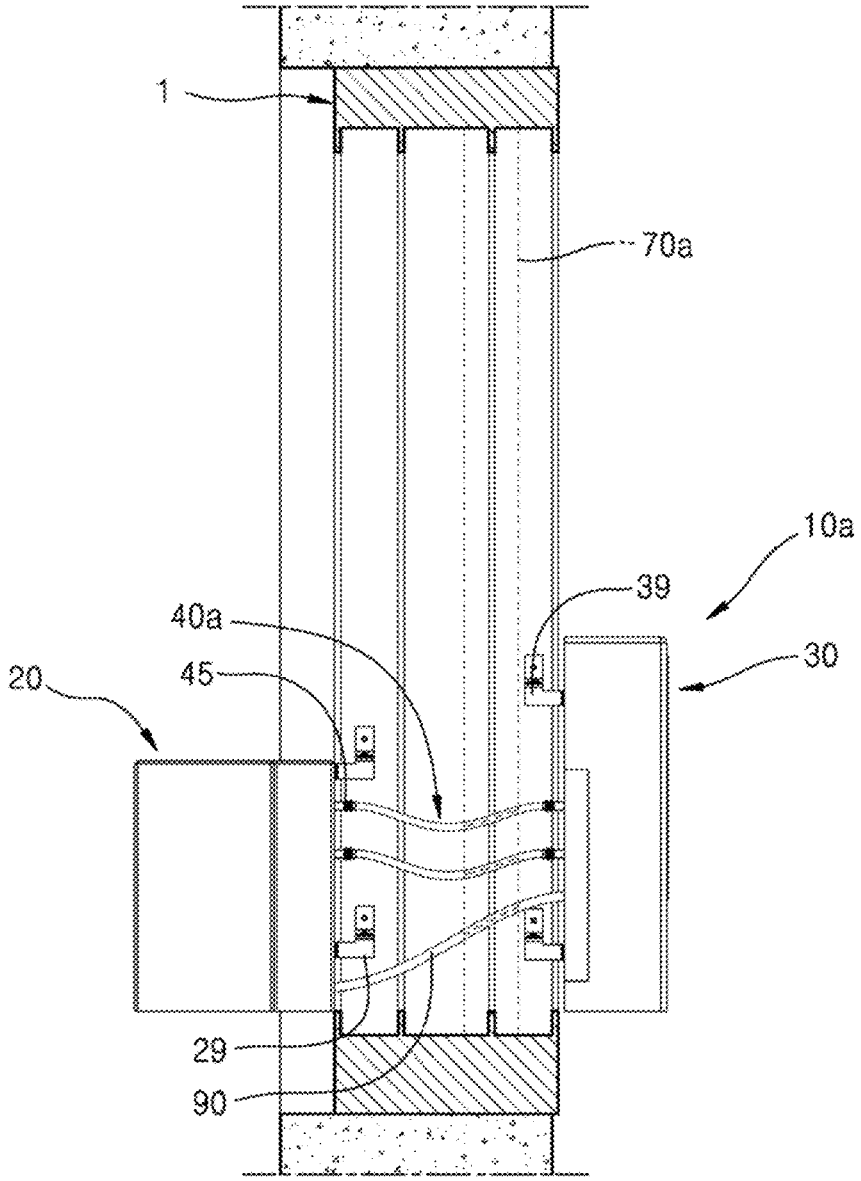
FIG. 24 is a side cross-sectional view of a window-type air-conditioner according to an embodiment of the disclosure installed on a window frame.
Figure 25:
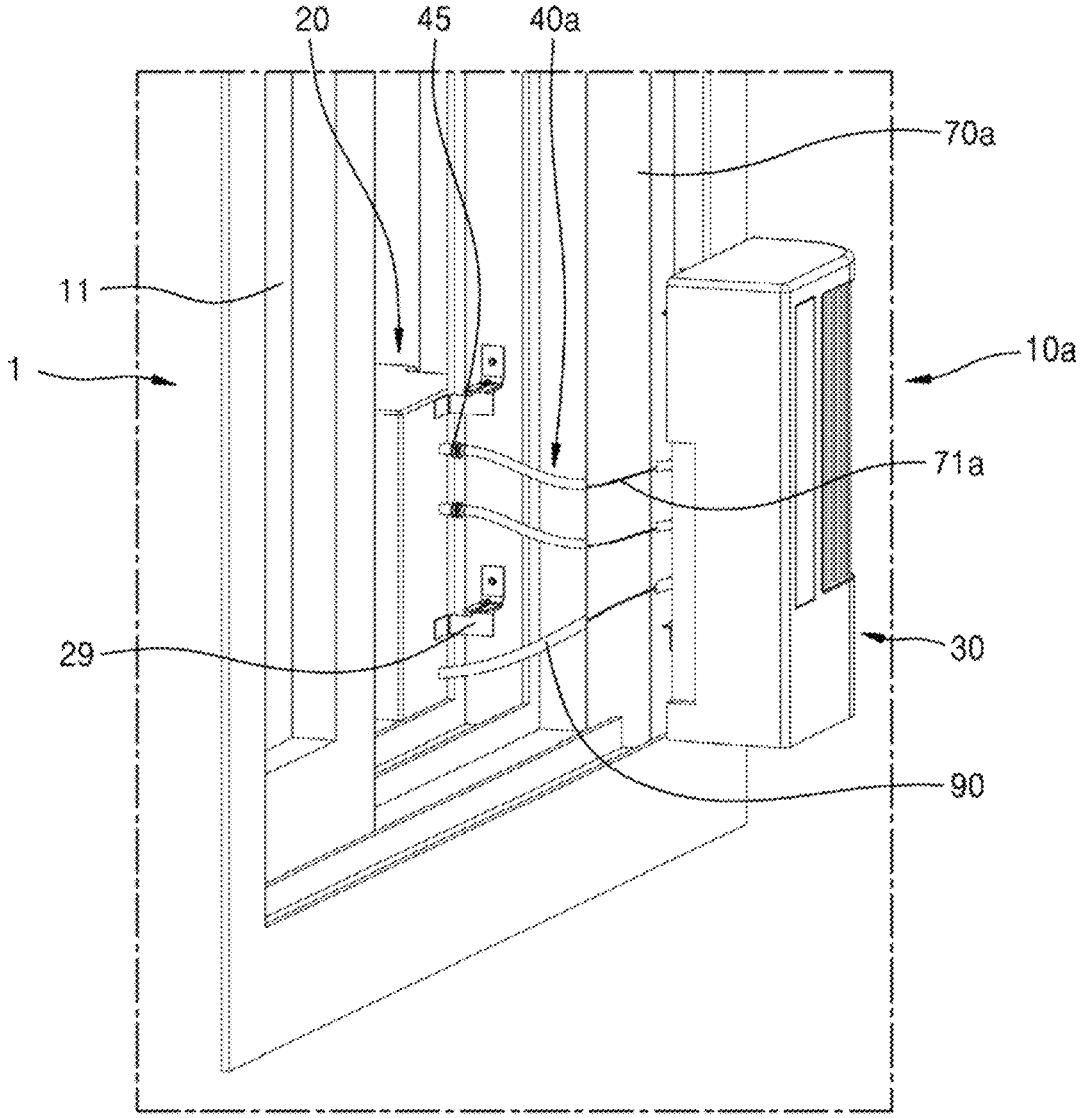
FIG. 25 is a perspective view of a window-type air-conditioner according to an embodiment of the disclosure installed on a window frame.

FIG. 23 is a perspective view of a sealing member of a window-type air-conditioner according to an embodiment of the disclosure. FIG. 24 is a side cross-sectional view of a window-type air-conditioner according to an embodiment of the disclosure being installed on a window frame. FIG. 25 is a perspective view of a window-type air-conditioner according to an embodiment of the disclosure being installed on a window frame.

Referring to FIGS. 16 and 23 to 25, the window-type air-conditioner 10*a* according to an embodiment of the disclosure may include a sealing member 70*a*. The sealing member 70*a* may be configured to seal between the window 11 and the window frame 1.

The sealing member 70*a* may include pipe through-holes 73 through which the flexible coolant pipe 40*a* and the drain pipe 90 pass. The sealing member 70*a* may include cut portions 71*a* into which the flexible coolant pipe 40*a* and the drain pipe 90 are inserted. The function of the pipe through-holes 73 is not limited thereto. For example, wires (not shown) of an electronic apparatus connecting between the outdoor module 20 and the indoor module 30 may pass through the pipe through-holes 73.

The sealing member 70*a* may include a blocking material to block external noise. The sealing member 70*a* may include an insulating member having an insulation function. For example, the sealing member 70*a* may include a foam material. However, the material of the sealing member 70*a* is not limited thereto.

Figure 26:
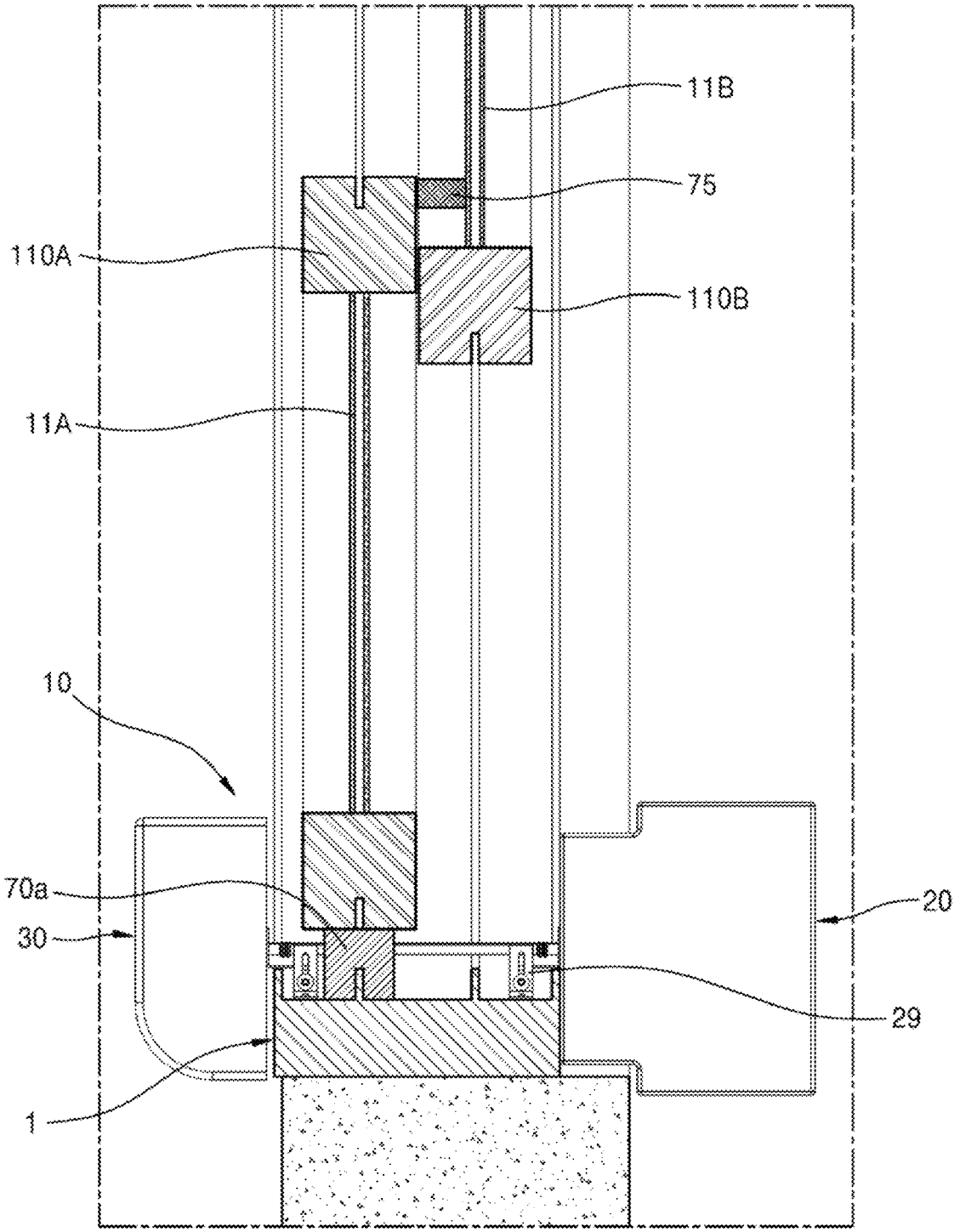
FIG. 26 is a cross-sectional view of an upper portion of a window-type air-conditioner according to an embodiment of the disclosure installed on a window frame.

FIG. 26 is a cross-sectional view of an upper portion of a window-type air-conditioner according to an embodiment of the disclosure being installed on a window frame.

Referring to FIGS. 16 and 26, the window 11 installed on the window frame 1 according to an embodiment of the disclosure may include a sash 110. The window 11 and the sash 110 installed on the window frame 1 may be designed to provide insulation to the inside and outside of the window frame 1 when the window 11 is completely closed when the window-type air-conditioner 10*a* is not installed. When the window 11 is closed while the window-type air-conditioner 10*a* is installed on the window frame 1, insulation may not be provided between the sash 110 of the window 11 and another window 11 adjacent thereto.

The window-type air-conditioner 10*a* according to an embodiment of the disclosure may include a second sealing member 75. The second sealing member 75 may function to block the flow of air between a sash 110A of a window 11A and a sash 110B of a window 11B adjacent thereto. The second sealing member 75 may be arranged between the sash 110A and the window 11B adjacent thereto. The second sealing member 75 may include a foam material. However, the arrangement and shape of the second sealing member 75 are not limited thereto.

Although embodiments have been described, these are merely exemplary, and those skilled in the art to which the disclosure pertains could make various modifications and changes from these descriptions. Therefore, it will be understood that various changes in form and details may be made therein without departing from the spirit and scope of the disclosure as defined by the following claims.

The invention claimed is:

1. A window-type air-conditioner installable on a window frame, the window-type air-conditioner comprising:

an outdoor module including:

a compressor configured to compress a coolant, an outdoor heat exchanger configured to generate heat exchange between outdoor air and the coolant, and an outdoor housing accommodating the compressor and the outdoor heat exchanger;

an indoor module including:

an indoor heat exchanger configured to generate heat exchange between indoor air and the coolant, and an indoor housing spaced apart from the outdoor housing, and accommodating the indoor heat exchanger;

a coolant pipe providing a flow path along which the coolant moves between the outdoor module and the indoor module;

a pipe cover accommodating the coolant pipe, and connecting the indoor module and the outdoor module;

a sealing member coupled to the pipe cover, and configured to provide a seal between an outer circumferential surface of the pipe cover and the window frame on a plane perpendicular to a direction in which the pipe cover extends, wherein the coolant pipe has a spiral shape that is expandable and compressible, and the pipe cover has a structure that is expandable and compressible, to adjust an interval between the outdoor module and the indoor module so that the interval corresponds to a thickness of the window frame, the structure of the pipe cover is a bellows structure including a plurality of corrugations, and the sealing member includes a coupling surface in contact with the outer circumferential surface of the pipe cover, the coupling surface including an uneven portion corresponding to the plurality of corrugations of the pipe cover.

2. The window-type air-conditioner of claim 1, wherein the coolant pipe is wound multiple times in the spiral shape around a virtual center axis.

3. The window-type air-conditioner of claim 2, wherein the virtual center axis of the coolant pipe extends in a direction from the outdoor module toward the indoor module.

4. The window-type air-conditioner of claim 1, wherein a virtual projection trajectory formed by an outer circumference of the spiral shape of the coolant pipe includes two line segments parallel to each other, a first curved line connecting a first pair of end portions of the two line segments to each other, and a second curved line connecting a second pair of end portions of the two line segments to each other.

5. The window-type air-conditioner of claim 1, wherein a virtual projection trajectory formed by an outer circumference of the spiral shape of the coolant pipe is oval.

6. The window-type air-conditioner of claim 1, wherein the coolant pipe includes:

a first coolant pipe providing a first flow path along which the coolant moves from the outdoor module to the indoor module, and a second coolant pipe providing a second flow path along which the coolant moves from the indoor module to the outdoor module, and a virtual projection trajectory formed by an outer circumference of the spiral shape of the first coolant pipe is greater than a virtual projection trajectory formed by an outer circumference of the spiral shape of the second coolant pipe.

7. The window-type air-conditioner of claim 6, wherein the virtual projection trajectory of the second coolant pipe is formed inside the virtual projection trajectory of the first coolant pipe.

8. The window-type air-conditioner of claim 1, wherein the coolant pipe includes a metal pipe.

9. The window-type air-conditioner of claim 1, further comprising:

a coil spring surrounding the coolant pipe, and configured to reduce stress on the coolant pipe when the interval between the outdoor module and the indoor module is adjusted.

10. The window-type air-conditioner of claim 1, further comprising:

a temporary support portion supporting the indoor module and the outdoor module at a fixed interval, and configured to be removed before the window-type air-conditioner is installed on the window frame.

* * * * *